US010053649B2

(12) United States Patent
Dietz

(10) Patent No.: US 10,053,649 B2
(45) Date of Patent: Aug. 21, 2018

(54) METHOD FOR PURIFYING REFINED LIPID PHASES

(71) Applicants: Drei Lilien PVG GmbH & Co. KG, Wiesbaden (DE); SE Tylose GmbH & Co. KG, Wiesbaden (DE)

(72) Inventor: Max Dietz, Wiesbaden (DE)

(73) Assignees: Drei Lilien PVG GmbH & Co. KG, Wiesbaden (DE); SE Tylose GmbH & Co. KG, Wiesbaden (DE)

( * ) Notice: Subject to any disclaimer, the term of this patent is extended or adjusted under 35 U.S.C. 154(b) by 0 days.

(21) Appl. No.: 15/310,822

(22) PCT Filed: Jun. 1, 2015

(86) PCT No.: PCT/EP2015/062182

§ 371 (c)(1),
(2) Date: Nov. 14, 2016

(87) PCT Pub. No.: WO2015/181399

PCT Pub. Date: Dec. 3, 2015

(65) Prior Publication Data

US 2017/0081611 A1 Mar. 23, 2017

(30) Foreign Application Priority Data

May 30, 2014 (DE) ..... 10 2014 007 740

(51) Int. Cl.

| | |
|---|---|
| ***C11B 3/10*** | (2006.01) |
| ***C11B 1/10*** | (2006.01) |
| ***C11B 3/16*** | (2006.01) |

(52) U.S. Cl.
CPC ..... *C11B 3/10* (2013.01); *C11B 1/10* (2013.01); *C11B 3/16* (2013.01)

(58) Field of Classification Search
CPC ..... C11C 1/10
See application file for complete search history.

(56) References Cited

U.S. PATENT DOCUMENTS

| | | | | |
|---|---|---|---|---|
| 3,472,840 A | | 10/1969 | Stone et al. | |
| 5,034,330 A | * | 7/1991 | Yamori | C12Q 1/002 204/403.11 |
| 5,298,639 A | * | 3/1994 | Toeneboehn | C11B 3/10 554/191 |
| 5,401,862 A | | 3/1995 | Gonus et al. | |
| 5,656,340 A | * | 8/1997 | Ubukata | C08G 77/455 349/123 |
| 2005/0115897 A1 | | 6/2005 | Dueppen et al. | |
| 2010/0077652 A1 | | 4/2010 | Gruber et al. | |

(Continued)

FOREIGN PATENT DOCUMENTS

WO 2009148919 12/2009

OTHER PUBLICATIONS

Bligh, E. G., et al., A Rapid Method of Total lipid Extraction and Purification, 1959, Canadian Journa of Biochemistry and Physiology, vol. 37, No. 8, pp. 911-917 (Year: 1959).*

(Continued)

*Primary Examiner* — Yate' K Cutliff
(74) *Attorney, Agent, or Firm* — Amin, Turocy & Watson LLP

(57) ABSTRACT

The present invention relates to a method for removing turbidity-inducing agents from a lipid phase.

6 Claims, 4 Drawing Sheets

| Table 1.3 | phosphorus (mg/kg) | calcium (mg/kg) | iron (mg/kg) | acid value (wt%) | water content (wt%) | turbidity | rep. water content (wt%) | rep. turbidity | anisidine (D0) | anisidine (D120) |
|---|---|---|---|---|---|---|---|---|---|---|
| crude oil | 820.0 | 42.4 | 26.2 | 1.2 | 1.1 | 1 | n.d. | n.d. | 6.3 | 87.5 |
| oil phase A | 32.2 | 2.1 | 19.4 | 1.4 | 0.4 | 1 | n.d. | n.d. | n.d. | n.d. |
| oil phase B | 16.1 | 1.9 | 3.1 | 0.6 | 1.2 | 2 | n.d. | n.d. | n.d. | n.d. |
| oil phase C | 1.0 | 0.001 | 0.01 | 0.05 | 1.8 | 3 | n.d. | n.d. | n.d. | n.d. |
| RT | 1.0 | 0.001 | 0.01 | 0.05 | 0.07 | 1 | 1.40 | 2 | 1.3 | 36.9 |
| T 1.1 | 1.0 | 0.001 | 0.01 | 0.02 | 0.01 | 1 | 0.04 | 1 | 0.5 | 6.1 |
| T 1.2 | 1.0 | 0.001 | 0.01 | 0.05 | 1.70 | 2 | 1.90 | 2 | 1.1 | 32.8 |
| T 1.3 | 1.0 | 0.001 | 0.01 | 0.05 | 1.80 | 2–3 | 1.80 | 2–3 | 0.9 | 29.1 |
| T 1.4 | 1.0 | 0.001 | 0.01 | 0.05 | 0.03 | 1 | 0.09 | 1 | 0.9 | 12.7 |
| T 1.5 | 1.0 | 0.001 | 0.01 | 0.05 | 1.50 | 2 | 1.60 | 2 | 1.5 | 38.7 |
| T 1.6 | 1.0 | 0.001 | 0.01 | 0.05 | 1.60 | 2 | 1.80 | 2 | 1.6 | 35.2 |
| T 1.7 | 1.0 | 0.001 | 0.01 | 0.05 | 0.04 | 1 | 0.12 | 1 | 0.7 | 14.1 |
| T 1.8 | 0.5 | 0.001 | 0.01 | 0.01 | 0.01 | 1 | 0.03 | 1 | 0.5 | 6.4 |
| T 1.9 | 1.0 | 0.001 | 0.01 | 0.05 | 0.08 | 1 | 0.15 | 1 | 0.8 | 11.8 |
| T 1.10 | 1.0 | 0.001 | 0.01 | 0.03 | 0.01 | 1 | 0.02 | 1 | 0.5 | 4.9 |
| T 1.11 | 1.0 | 0.001 | 0.01 | 0.05 | 0.05 | 1 | 0.14 | 1 | 0.7 | 8.8 |
| T 1.12 | 1.0 | 0.001 | 0.01 | 0.03 | 0.02 | 1 | 0.04 | 1 | 0.5 | 6.1 |
| T 2.1 | 1.0 | 0.001 | 0.01 | 0.05 | 0.01 | 1 | 0.02 | 1 | 0.5 | 6.2 |
| T 2.2 | 1.0 | 0.001 | 0.01 | 0.05 | 0.03 | 1 | 0.05 | 1 | 0.5 | 7.4 |
| T 2.3 | 1.0 | 0.001 | 0.01 | 0.05 | 0.12 | 1 | 0.28 | 1 | 0.7 | 18.9 |
| T 2.4 | 1.0 | 0.055 | 0.01 | 0.05 | 1.32 | 2 | 1.78 | 2 | 1.3 | 34.8 |
| T 2.5 | 1.0 | 0.001 | 0.01 | 0.05 | 1.43 | 2 | 1.89 | 2 | 1.1 | 31.4 |
| T 2.6 | 1.0 | 0.001 | 0.01 | 0.05 | 1.50 | 2 | 1.73 | 2 | 1.5 | 40.1 |
| T 2.7 | 1.0 | 0.001 | 0.01 | 0.05 | 1.64 | 2 | 1.75 | 2 | 1.3 | 37.9 |
| T 2.8 | 1.0 | 0.001 | 0.01 | 0.05 | 0.05 | 1 | 0.08 | 1 | 0.5 | 7.0 |
| T 2.9 | 1.0 | 0.001 | 0.01 | 0.05 | 0.03 | 1 | 0.05 | 1 | 0.5 | 16.1 |
| T 2.10 | 1.0 | 0.001 | 0.01 | 0.03 | 0.01 | 1 | 0.03 | 1 | 0.5 | 5.9 |

oil turbidity: 1 = transparent, 2 = slightly turbid, 3 = moderately turbid, 4 = highly turbid, 5 = milky

(56) References Cited

U.S. PATENT DOCUMENTS

2010/0260861 A1* 10/2010 Weinstock ..... A61K 31/27
424/520
2013/0323396 A1 12/2013 Norn et al.

OTHER PUBLICATIONS

Rouser, G., et al., Methods in Enzymology, (edited by J.M. Lowenstein, Academic Press, USA) Chapter 47, Diethylaminoethyl and triethylaminoethyl cellulose column chromatographic procedures for phospholipids, glycolipids and pigments, vol. 14, pp. 272-317 (Year: 1969).*
International Search Report for International Patent Application No. PCT/EP2015/062182 dated Aug. 31, 2015, 8 pages.
Written Opinion for International Patent Application No. PCT/EP2015/062182 dated Aug. 31, 2015, 8 pages.
Klemm, et al. Comprehensive Cellulose Chemistry, Wiley-VCH, 1998, vol. 2, pp. 255-260.
Heinze, et al. Polymer Science, 2012, vol. 10, pp. 83-152.

* cited by examiner

Figure 1

| Table 1.3 | phosphorus (mg/kg) | calcium (mg/kg) | iron (mg/kg) | acid value (wt%) | water content (wt%) | turbidity | rep. water content (wt%) | rep. turbidity | anisidine (D0) | anisidine (D120) |
|---|---|---|---|---|---|---|---|---|---|---|
| crude oil | 820.0 | 42.4 | 26.2 | 1.2 | 1.1 | 1 | n.d. | n.d. | 6.3 | 87.5 |
| oil phase A | 32.2 | 2.1 | 19.4 | 1.4 | 0.4 | 1 | n.d. | n.d. | n.d. | n.d. |
| oil phase B | 16.1 | 1.9 | 3.1 | 0.6 | 1.2 | 2 | n.d. | n.d. | n.d. | n.d. |
| oil phase C | 1.0 | 0.001 | 0.01 | 0.05 | 1.8 | 3 | n.d. | n.d. | n.d. | n.d. |
| RT | 1.0 | 0.001 | 0.01 | 0.05 | 0.07 | 1 | 1.40 | 2 | 1.3 | 36.9 |
| T 1.1 | 1.0 | 0.001 | 0.01 | 0.02 | 0.01 | 1 | 0.04 | 1 | 0.5 | 6.1 |
| T 1.2 | 1.0 | 0.001 | 0.01 | 0.05 | 1.70 | 2 | 1.90 | 2 | 1.1 | 32.8 |
| T 1.3 | 1.0 | 0.001 | 0.01 | 0.05 | 1.80 | 2–3 | 1.80 | 2–3 | 0.9 | 29.1 |
| T 1.4 | 1.0 | 0.001 | 0.01 | 0.05 | 0.03 | 1 | 0.09 | 1 | 0.9 | 12.7 |
| T 1.5 | 1.0 | 0.001 | 0.01 | 0.05 | 1.50 | 2 | 1.60 | 2 | 1.5 | 38.7 |
| T 1.6 | 1.0 | 0.001 | 0.01 | 0.05 | 1.60 | 2 | 1.80 | 2 | 1.6 | 35.2 |
| T 1.7 | 1.0 | 0.001 | 0.01 | 0.05 | 0.04 | 1 | 0.12 | 1 | 0.7 | 14.1 |
| T 1.8 | 0.5 | 0.001 | 0.01 | 0.01 | 0.01 | 1 | 0.03 | 1 | 0.5 | 6.4 |
| T 1.9 | 1.0 | 0.001 | 0.01 | 0.05 | 0.08 | 1 | 0.15 | 1 | 0.8 | 11.8 |
| T 1.10 | 1.0 | 0.001 | 0.01 | 0.03 | 0.01 | 1 | 0.02 | 1 | 0.5 | 4.9 |
| T 1.11 | 1.0 | 0.001 | 0.01 | 0.05 | 0.05 | 1 | 0.14 | 1 | 0.7 | 8.8 |
| T 1.12 | 1.0 | 0.001 | 0.01 | 0.03 | 0.02 | 1 | 0.04 | 1 | 0.5 | 6.1 |
| T 2.1 | 1.0 | 0.001 | 0.01 | 0.05 | 0.01 | 1 | 0.02 | 1 | 0.5 | 6.2 |
| T 2.2 | 1.0 | 0.001 | 0.01 | 0.05 | 0.03 | 1 | 0.05 | 1 | 0.5 | 7.4 |
| T 2.3 | 1.0 | 0.001 | 0.01 | 0.05 | 0.12 | 1 | 0.28 | 1 | 0.7 | 18.9 |
| T 2.4 | 1.0 | 0.055 | 0.01 | 0.05 | 1.32 | 2 | 1.78 | 2 | 1.3 | 34.8 |
| T 2.5 | 1.0 | 0.001 | 0.01 | 0.05 | 1.43 | 2 | 1.89 | 2 | 1.1 | 31.4 |
| T 2.6 | 1.0 | 0.001 | 0.01 | 0.05 | 1.50 | 2 | 1.73 | 2 | 1.5 | 40.1 |
| T 2.7 | 1.0 | 0.001 | 0.01 | 0.05 | 1.64 | 2 | 1.75 | 2 | 1.3 | 37.9 |
| T 2.8 | 1.0 | 0.001 | 0.01 | 0.05 | 0.05 | 1 | 0.08 | 1 | 0.5 | 7.0 |
| T 2.9 | 1.0 | 0.001 | 0.01 | 0.05 | 0.03 | 1 | 0.05 | 1 | 0.5 | 16.1 |
| T 2.10 | 1.0 | 0.001 | 0.01 | 0.03 | 0.01 | 1 | 0.03 | 1 | 0.5 | 5.9 |

oil turbidity: 1 = transparent, 2 = slightly turbid, 3 = moderately turbid, 4 = highly turbid, 5 = milky

Figure 2

| Table 2.2 | phosphorus (mg/kg) | iron (mg/kg) | magnesium (mg/kg) | acid value (wt%) | water content (wt%) | turbidity | rep. water content (wt% | rep. turbidity |
|---|---|---|---|---|---|---|---|---|
| crude oil | 56 | 25.2 | 16.5 | 2.4 | 1.1 | 1 | n.d. | n.d. |
| oil phase A | 12 | 3.4 | 1.34 | 1.10 | 1.4 | 1 | n.d. | n.d. |
| oil phase B | 1.1 | 0.05 | 0.06 | 0.11 | 1.9 | 2 | n.d. | n.d. |
| T 1.1 | 0.7 | 0.01 | 0.02 | 0.04 | 0.01 | 1 | 0.03 | 1 |
| T 1.2 | 0.7 | 0.02 | 0.03 | 0.05 | 0.03 | 1 | 0.04 | 1 |
| T 1.3 | 0.8 | 0.04 | 0.05 | 0.05 | 0.09 | 1 | 0.10 | 1 |
| T 1.4 | 0.8 | 0.01 | 0.02 | 0.07 | 0.08 | 1 | 0.11 | 1 |
| T 1.5 | 0.9 | 0.04 | 0.03 | 0.08 | 0.06 | 1 | 0.13 | 1 |
| T 1.6 | 0.8 | 0.03 | 0.05 | 0.07 | 0.05 | 1 | 0.09 | 1 |
| T 1.7 | 0.8 | 0.02 | 0.04 | 0.06 | 0.08 | 1 | 0.12 | 1 |
| T 1.8 | 0.8 | 0.01 | 0.02 | 0.05 | 0.08 | 1 | 0.13 | 1 |
| T 1.9 | 1.1 | 0.01 | 0.02 | 0.04 | 0.02 | 1 | 1.30 | 2 |
| T 2.1 | 0.9 | 0.05 | 0.06 | 0.08 | 0.14 | 1 | 0.19 | 1 |
| T 2.2 | 0.8 | 0.05 | 0.04 | 0.09 | 0.09 | 1 | 0.12 | 1 |
| T 2.3 | 0.8 | 0.02 | 0.03 | 0.06 | 0.01 | 1 | 0.02 | 1 |
| T 2.4 | 0.8 | 0.04 | 0.02 | 0.07 | 0.10 | 1 | 0.15 | 1 |
| T 2.5 | 0.8 | 0.05 | 0.06 | 0.07 | 0.07 | 1 | 0.09 | 1 |
| T 2.6 | 0.7 | 0.03 | 0.06 | 0.05 | 0.01 | 1 | 0.02 | 1 |

rep. = repeated introduction of water; oil turbidity: 1 = transparent, 2 = slightly turbid, 3 = moderately turbid, 4 = highly turbid, 5 = milky; n.d. = not determined.

Figure 3

| Table 5.2 | prepurified oil | | | extraction agent | | | | | | | | | | | | | | |
|---|---|---|---|---|---|---|---|---|---|---|---|---|---|---|---|---|---|---|
| | | | | a) | | | b) | | | c) | | | d) | | | e) | | |
| ref. method | WC | TR | rep. WC | WC | TR | rep. WC | WC | TR | rep. WC | WC | TR | rep. WC | WC | TR | rep. WC | WC | TR | rep. WC |
| T 1 | 1.82 | 1–2 | 3.82 | 0.43 | 1 | 0.86 | 0.53 | 1 | 0.82 | 0.96 | 1 | 1.23 | 0.35 | 1 | 0.56 | 0.29 | 1 | 0.31 |
| T 2 | 3.61 | 2–3 | 3.84 | 0.03 | 1 | 0.09 | 0.09 | 1 | 0.12 | 0.09 | 1 | 0.12 | 0.03 | 1 | 0.07 | 0.03 | 1 | 0.06 |
| T 3 | 2.22 | 2 | 4.19 | 0.28 | 1 | 0.59 | 0.32 | 1 | 0.65 | 1.22 | 1–2 | 1.45 | 0.94 | 1 | 1.22 | 0.86 | 1 | 0.94 |
| T 4 | 0.21 | 1 | 3.92 | 0.21 | 1 | 1.23 | 0.17 | 1 | 1.21 | 0.1 | 1 | 1.43 | 0.28 | 1 | 0.43 | 0.19 | 1 | 0.29 |
| T 5 | 2.55 | 2 | 3.52 | 0.08 | 1 | 0.1 | 0.06 | 1 | 0.11 | 0.11 | 1 | 0.13 | 0.08 | 1 | 0.11 | 0.08 | 1 | 0.1 |
| T 6 | 1.92 | 2 | 3.45 | 0.32 | 1 | 0.43 | 0.29 | 1 | 0.32 | 0.44 | 1 | 0.62 | 0.18 | 1 | 0.23 | 0.13 | 1 | 0.18 |
| T 7 | 2.32 | 2 | 3.62 | 0.48 | 1 | 0.65 | 0.47 | 1 | 0.68 | 0.82 | 1 | 1.12 | 0.43 | 1 | 0.59 | 0.44 | 1 | 0.51 |
| T 8 | 3.83 | 3 | 3.98 | 0.03 | 1 | 0.07 | 0.09 | 1 | 0.1 | 0.11 | 1 | 0.07 | 0.02 | 1 | 0.09 | 0.01 | 1 | 0.05 |
| T 9 | 0.32 | 1 | 3.86 | 0.21 | 1 | 0.92 | 0.28 | 1 | 1.12 | 0.2 | 1 | 1.34 | 0.18 | 1 | 0.45 | 0.15 | 1 | 0.3 |
| T 10 | 2.45 | 2 | 4.01 | 0.21 | 1 | 0.32 | 0.28 | 1 | 0.3 | 0.44 | 1 | 0.62 | 0.31 | 1 | 0.49 | 0.21 | 1 | 0.31 |

WC = water content (% by weight); Rep. = repeated introduction of water; TR: oil turbidity: 1 = transparent, 2 = slightly turbid, 3 = moderately turbid, 4 = highly turbid, 5 = milky; n.d. = not determined.

Figure 4

| Table 6.1 | adsorption or complexing agent | | | | | | |
|---|---|---|---|---|---|---|---|
| | a) | b) | c) | d) | e) | f) | g) |
| minimum metered amount | 0.4 wt% | 0.6 wt% | 1.2 wt% | 1.4 wt% | 0.5 molar/ 0.4 wt% | 0.5 molar/ 0.8 wt% | 0.5 molar/ 0.2 wt% |
| product loss | 0.05 wt% | 0.09 wt% | 0.11 wt% | 0.18 wt% | 0 | 0 | 0 |

Figure 5

| Table 7 | purified oil | | | extraction agent | | | | | | | | | | | | | | | |
|---|---|---|---|---|---|---|---|---|---|---|---|---|---|---|---|---|---|---|---|
| | | | | a) | | | | b) | | | | c) | | | | d) | | | |
| test arm | WC | TR | rep. WC | WC | TR | FTU | rep. WC | WC | TR | FTU | rep. WC | WC | TR | FTU | rep. WC | WC | TR | FTU | rep. WC |
| A1) | 2.45 | 2 | 3.82 | | | | | | | | | | | | | | | | |
| A1") | | | | 0.01 | 1 | 5 | 0.06 | 0.04 | 1 | 7 | 0.08 | 0.03 | 1 | 5 | 0.05 | 0.02 | 1 | 5 | 0.03 |
| A2) | 0.1 | 1 | 3.1 | | | | | | | | | | | | | | | | |
| A2") | | | | 0.1 | 1 | 10 | 3.12 | 0.1 | 1 | 13 | 2.99 | 1.9 | 2 | 48 | 2.58 | 1.8 | 1–2 | 22 | 2.1 |
| A3) | 2.55 | 2 | 2.92 | | | | | | | | | | | | | | | | |
| A3") | | | | 0.02 | 1 | 5 | 0.03 | 0.03 | 1 | 5 | 0.06 | 0.05 | 1 | 5 | 0.07 | 0.03 | 1 | 5 | 0.02 |
| A4f) | 1.82 | 2 | 2.81 | | | | | | | | | | | | | | | | |
| B1) | 2.22 | 2 | 3.53 | | | | | | | | | | | | | | | | |
| B1") | | | | 0.11 | 1 | 12 | 0.15 | 0.13 | 1 | 15 | 0.16 | 0.11 | 1 | 11 | 0.14 | 0.08 | 1 | 9 | 0.13 |
| B2) | 0.11 | 1 | 3.34 | | | | | | | | | | | | | | | | |
| B2") | | | | 0.1 | 1 | 13 | 3.42 | 0.09 | 1 | 12 | 3.21 | 2.11 | 2 | 47 | 2.99 | 1.45 | 1–2 | 19 | 2.33 |
| B3) | 2.5 | 2 | 3.12 | | | | | | | | | | | | | | | | |
| B3") | | | | 0.09 | 1 | 8 | 0.11 | 0.12 | 1 | 12 | 0.17 | 0.09 | 1 | 9 | 0.12 | 0.08 | 1 | 7 | 0.1 |
| C") | | | | 0.32 | 1 | 16 | 2.58 | 0.3 | 1 | 14 | 2.24 | 1.45 | 1–2 | 22 | 2.41 | 1.78 | 1–2 | 18 | 2.1 |
| C1) | 2.41 | 2 | 3.59 | | | | | | | | | | | | | | | | |
| C1" | | | | 0.04 | 1 | 5 | 0.08 | 0.05 | 1 | 5 | 0.1 | 0.04 | 1 | 5 | 0.05 | 0.02 | 1 | 5 | 0.04 |

WC = water content (% by weight); Rep. = repeated introduction of water; TR: oil turbidity: 1 = transparent, 2 = slightly turbid, 3 = moderately turbid, 4 = highly turbid, 5 = milky; FTU = units of the turbidimetry measurement.

METHOD FOR PURIFYING REFINED LIPID PHASES

The present invention relates to a method for removing turbidity-inducing agents from a lipid phase.

BACKGROUND OF THE INVENTION

Lipid phases of biogenic origin contain not only the neutral fats sought after for further use, such as triglycerides for example, but also in most cases numerous organic accompanying substances which, in the biological context from which the lipids originate, ensure solubilization. Therefore, despite their altogether amphiphilic properties, said accompanying substances frequently have a noticeably large lipophilicity. This depends on the ratio of hydrophilic and hydrophobic molecular parts. Whereas compounds having a large water-molecule binding capacity, as is the case for the hydratable phospholipids (phosphatidylcholine and phosphatidyl-ethanolamine) for example, can be easily washed out by an introduction of water into a lipid phase, the same cannot be said for the structurally very similar phospholipids referred to as nonhydratable (phosphatidylinositols and phosphatidylserine). Furthermore, most lipid phases also contain glycolipids and glycoglycerolipids, which frequently have fatty acid residues having very long chains and, despite the presence of polar groups, cannot be easily flushed out of a lipid mixture by means of an aqueous medium. Furthermore, most lipid phases of plant origin also contain sterol glycosides and also hydrophobic dyes such as carotenes and chlorophylls. Such compounds are completely water-insoluble and therefore remain in the lipid phase during an aqueous refining process. Nevertheless, all the aforementioned compounds are capable of binding low amounts of water molecules via electrostatic interaction forces, for example to OH groups. Furthermore, the aforementioned compounds are usually present together in complex structures, with the inclusion of ions from the group of the alkaline earth metals and of the metals. This further increases the cohesion in the region of hydrophilic groups. This explains why it is necessary to purify such lipid mixtures using aqueous media containing strong bases and strong acids. Nevertheless, it has so far not been possible to demonstrate for any method that a complete removal of compounds which can bind water ions via OH groups is possible. As a result, it is consequently also not possible, by means of simple aqueous refining techniques, to lower the residual water content or the water uptake capacity of the refined oil to an extent that satisfies the product requirements for food quality as well as for a lipid phase used as technical product, for example for biogenic fuels. Drying of aqueously refined lipid mixtures according to the prior art is achieved by clearing the pretreated lipid phases of water fractions situated therein by either heating or a vacuum-drying process, it being realistically possible to achieve a reduction in the residual water content to values between 0.05 and 0.15% by weight. Such a drying process increases the refining costs. Furthermore, the water-binding compounds remain in the lipid phase, and so, in the event of a repeated introduction of water, there can be a reoccurrence of water binding and thus turbidity of the lipid phase. Therefore, said compounds are sometimes also referred to as turbidity-inducing agents, and, in this connection, a turbidity owing to what is understood here to mean turbidity-inducing agents does not become visible as a result of complex organic compounds themselves becoming visible; instead, the turbidity arises owing to water molecules which are bound by said organic compounds. In contrast to complex organic structures which are likewise referred to as turbidity-inducing agent and which can be imaged by means of optical techniques and, as corpuscular structures, are therefore also extractable and removable by means of a filtration, the turbidity-inducing agents referred to here are characterized in that they cannot be removed by means of a filter technique based on a size exclusion of corpuscular particles.

The presence of such organic compounds can also adversely affect the oxidation stability of the lipid phases in which they are situated. Therefore, their removal from a lipid phase is desirable, since this yields a distinctly improved refinement product. The refining steps downstream, according to the prior art, of an aqueous refining of triglyceride mixtures, such as a treatment with fuller's earth and/or a vapor treatment (deodorization), are capable of distinctly reducing the water-binding capacity of aqueously prerefined lipid phases. A disadvantage here is that the process steps following the aqueous refining steps lead to a considerable increase in the production costs. Furthermore, a treatment with fuller's earth also leads to a relevant loss of triglycerides, which are removed thereby.

An aqueous refining method has now been established, by means of which a distinctly more efficient removal of amphiphilic accompanying substances from a lipid phase is possible. Here, it is possible to remove very efficiently both amphiphilic compounds containing, for example, saccharides, such as glycolipids from lipid phases, and carboxylic acids. Furthermore, there is also a relevant removal of dyes, achieving, for example, a quality for such a refined oil which no longer necessitates a further treatment with a fuller's earth or a deodorization. This allows an efficient and cost-effective aqueous refining of biogenic lipid phases, making it possible to save process costs. However, it has become apparent that, specifically in the case of very complete removal of glycolipids, free fatty acids, phosphorus-containing compounds and alkaline earth metal ions, the refined lipid phases which are obtained after a centrifugal removal of these compounds together with the aqueous phases still have a distinct turbidity. In this case, there were amounts of water residual content of >1.5% by weight, and so the oils did not attain the required product specification, although a depletion of the phosphorus content to values of <2 ppm and of the content of calcium, magnesium and iron to values of <0.05 ppm and of the content of free fatty acids of <0.15% by weight had been achieved. When such a refined turbid oil phase was subjected to a drying process, for example by means of a vacuum-drying process, it was possible to reduce the residual moisture content to <0.1% by weight. The dried oils were transparent. By mixing with water, relevant amounts of water could be introduced into such oils, and so said oils became turbid again and could not be clarified by centrifugal process technologies. A reduction in the residual moisture of a refined lipid phase is desired in order to obtain an extremely clear oil; however, the residual moisture is also a crucial determinant for the improvement of the quality of the oil. Another aspect of a residual moisture of a lipid phase concerns storage stability, which is adversely affected by a relatively high content of water molecules remaining in a lipid phase. However, this also occurs when the lipid phase contains compounds which can bind water molecules, for example from the air. Therefore, it is necessary to reduce the residual water content to a product-specific minimum and desirable to eliminate organic compounds which promote an uptake of water into the lipid phase. In lipid phases and especially in oils and fats of plant or animal origin, there are chemical reactions which occur to a variable extent dependent on the storage conditions (air/light exposure, temperature conditions, container surfaces) and also on the presence of compounds which can bring about an oxidation of carbon double bonds (see p-anisidine value determination embodiments), and on the presence of compounds which allow a binding or reduction of free radicals, such as tocopherols, polyphenols or squalenes. The oxidative processes can give rise to, inter alia, aldehydes, ketones and free fatty acids, which further quicken the oxidative processes and are largely responsible for off-flavors in plant oils. During a classic refining method, the degumming method generally leads to a reduction in compounds which cause oxidative processes. The treatment of oils with fuller's earth can lead to acid-catalyzed oxidations; furthermore, compounds having antioxidative properties are depleted in this case to a varying extent, and so this method step can distinctly worsen the oxidation stability of an oil. In principle, the same applies to the deodorization process, especially when relatively high vapor temperatures (>220° C.) and a relatively long residence time (>15 minutes) of the oil are required. Therefore, storage stability is affected to a varying extent by the classic methods. In comparison to cold-pressed oils, such refined oils therefore frequently have no advantage with respect to storage stability, since, in the native oils, the antioxidants situated therein were left and no compounds which promote an autoxidation were added. Substances which promote an autoxidation usually have free-radical or free-radical-forming groups, or have a binding capacity for water molecules. A specific depletion of these compounds is not possible according to the prior art.

It has been possible to show that water extraction methods, such as a vacuum-drying process, lead to the desired removal of the residual water contents. However, the use of these techniques makes the aqueous refining method uneconomical. Furthermore, a repeated introduction of water into a lipid phase which had been aqueously refined and then treated by means of vacuum drying is still possible. This considerably impairs the product properties of the lipid phases. Since accompanying substances were already depleted in said lipid phases to an extent which no longer necessitates further refining steps, such as a bleaching or deodorization, and in order to clear the thus obtained lipid phases of the turbidity-inducing agents still present in an economical manner and a manner gentle to the product and thus, firstly, to reduce the residual water content to the required extent and, secondly, to reduce the ability of water to be introduced again, a new method was required. Surprisingly, a very simple and effective method has now been found, which, for such a well prepurified but turbid lipid phase, allows a removal of the residual content of water from a lipid phase which can be obtained following an aqueous refining process and, at the same time, also removes the turbidity-inducing agents responsible therefor. Furthermore, since the method can be carried out with comparatively inexpensive compounds at ambient temperatures and without relevant apparatus expenditure, with simultaneously only very low to completely negligible loss of neutral lipids, said method represents a considerable improvement in relation to the above-described methods from the prior art and satisfies the desired conditions. It is therefore an object of the present invention to provide methods for drying lipid phases with simultaneous removal of water-binding organic turbidity-inducing agents.

OBJECT OF THE INVENTION

It is an object of the present invention to provide methods for removing turbidity-inducing agents from a lipid phase.

According to the invention, this object is achieved by the technical teaching of the independent claims. Further advantageous designs of the invention are revealed by the dependent claims, the description, the figures and the examples.

DETAILED DESCRIPTION OF THE INVENTION

Biogenic lipid phases which have been obtained under anhydrous conditions mostly have a clear appearance, provided that suspended solids, which are, confusingly, frequently also referred to as turbidity-inducing agents in the literature, have been filtered out. Frequently, an introduction of water into said lipid phases can be achieved only with difficulty, since the compounds capable of binding water molecules are in complexed form in the lipid phase such that they are shielded by the neutral lipid phase surrounding them. This complex cohesion, which is made possible especially by nonhydratable phospholipids, and also by alkaline earth metal ions and metal ions, must firstly be broken, so that said compounds can interact with water molecules and, as a result, be transferred to an aqueous phase for their subsequent removal with the aqueous phase. Inevitably, this leads to a breaking-apart of bound complexed organic compounds which can likewise bind water molecules, for example via OH groups, but owing to their high lipophilicity cannot be transferred to the aqueous phase. This theory is reinforced by observations which were made during the refining of triglyceride mixtures. Here, it became apparent that for oils having a very high content of accompanying substances, there was, after each aqueous refining step, an increase in the turbidity of the triglyceride mixture following a centrifugal removal of the aqueous phase, despite an attained distinct depletion of accompanying substances. This is especially the case when glycolipids and glyceroglycolipids are situated in the lipid phase. If, in the case of these lipid phases, there is not only an optional classic aqueous degumming, which can be carried out using pure water and/or an acid (e.g., phosphoric acid), but also a subsequent at least 2-step treatment with slightly to highly basic compounds, an optimal reduction in accompanying substances is possible. In this case, it has become apparent that when at least one of the basic aqueous refining steps is carried out with a dissolved guanidine-group- or amidine-group-bearing compound, it is possible to obtain lipid phases in which a highly efficient depletion of accompanying substances is achieved, with a content of phosphorus of <5 ppm (or <5 mg/kg) of neutralizable acids of <0.15% by weight and a practically complete extraction of alkaline earth metals and metal ions to values <0.05 ppm (or <0.05 mg/kg) with simultaneously considerable reduction of plant dyes (such as chlorophylls for example) in the lipid phases obtained. On the other hand, the water content and the turbidity in the refined oil increased when especially good refining results were achieved. This became apparent especially when, for refining, an intensive-mixer-based introduction was carried out with an aqueous solution containing guanidine- or amidine-group-bearing compounds. The resulting emulsions were distinctly more turbid than after a stirring-based introduction of the aqueous refining solution. This is caused by a substantially more homogeneous distribution of the water fraction in the oil phase, and it was possible to demonstrate this by measurement of the droplet sizes situated therein by means of a DLS measurement. Furthermore, the tendency to coalescence of the formed droplets was considerably lower after an intensive introduction of the aqueous phase than after a stirring-based introduction. The long-term stability of such an emulsion was substantially higher too. Nevertheless, specifically in the case of these highly stable emulsions, it was possible to achieve a phase separation by centrifugation; however, the oils obtained were more turbid than was the case after a stirring-based introduction of the aqueous refining solution. In the case of these turbid oil phases, it was also not possible to achieve a water removal by varying the refining method, for example by different amounts of the aqueous solutions introduced by an intensive mixer in the lipid phase or by changes in the conditions for the centrifugal phase separation (change in the centrifugation time or the centrifugal acceleration).

Therefore, it has been possible to demonstrate that, although a more complete depletion of accompanying oil substances can be achieved by a more intensive introduction of an aqueous phase containing guanidine- or amidine-group-bearing compounds than with a stirring-based introduction, the degree of turbidity of the oil phase obtained is at the same time stronger than that in the case of a refining process with a stirring-based introduction of the aqueous phase.

The turbidity of the lipid phases that was established by a hydration of the water-binding organic turbidity-inducing agents as a result of the aqueous refining with at least one guanidine-group- or amidine-group-carrying compound remained completely unchanged for months; a spontaneous phase separation did not occur. Surprisingly, it was found that this hydration of water-binding lipophilic organic compounds can be utilized to adhere or to complex such compounds, and, as a result, they can be extracted from their organic matrix and thus be separated via physical methods.

This is also astounding because, despite the attained reduction in the known water-binding compounds from a lipid phase, which can be removed in the context of an aqueous refining process, and, in particular, practically complete removal of alkaline earth metal ions and metal ions, such biogenic lipid phases still contained water-binding organic compounds which cannot be transferred to an aqueous phase, and so said compounds therefore have a very high lipophilicity, with a low number or absence of ionizable groups. In actual fact, biogenic lipid phases contain such compounds in variable amounts, such as, for example, sterols, squalenes, phenols, waxes, wax acids, vitamins, glycolipids, or dyes.

Surprisingly, it has now been found that cellulose compounds allow a complete clarification of the hydrated turbid oils which are obtained from an aqueous refining that is carried out as described herein and for which there were subsequently characteristic oil number values as must be observed for, for example, edible oils, such as a residual phosphorus content of <5 ppm (or <5 mg/kg) and a content of free fatty acids of <0.15% by weight. This is all the more surprising because the cellulose products according to the invention can be distributed only dispersely in an oil phase and have only a limited binding capacity for water.

These results are also astonishing because the same cellulose compounds had no effect on the extractability of the water-binding organic turbidity-inducing agents when they were added to a triglyceride mixture either before the aqueous refining steps, or were added to a triglyceride mixture following such an aqueous refining, which mixture had been subjected to a vacuum-drying process and only had a low residual water content. In both cases, the removal of the cellulose preparations was followed by a renewed possibility of the introduction water into the lipid phase, whereas this was no longer the case after an inventive extraction of the water-binding organic turbidity-inducing agents.

Therefore, a particularly advantageous effect of the method according to the invention is ameliorating an aqueously refined lipid phase in which the water-binding organic turbidity-inducing agents are present in a hydrated form, by achieving here an interaction of the turbidity-inducing agents with other compounds, and so the turbidity-inducing agents can be made extractable from their organic matrix. Therefore, for the interaction of water-binding organic turbidity-inducing agents which allows the inventive removal of the turbidity-inducing agents, the removal (extraction) thereof from a structure with other fat-accompanying substances is specifically very possible when an aqueous refining is carried out at least with a solution containing guanidine-group- or amidine-group-bearing compounds and said turbidity-inducing agents become hydratable as a result of an optimal depletion of other water-soluble compounds and as a result of the (simultaneous) presence of water. In this connection hydrated means an attachment of water molecules. The presence of water molecules on the turbidity-inducing agents to be removed then represents the important determinant for the inventive interaction in form of an adsorption and/or complexing in relation to the extractability of the water-binding organic turbidity-inducing agents.

A preferred embodiment is therefore the provision of a lipid phase in method step a), in which organic turbidity-inducing agents are present in a hydrated form.

According to the invention, the object is achieved by a method for adsorbing and extracting or complexing and extracting water-binding organic lipophilic turbidity-inducing agents of aqueously refined lipid phases, characterized by a) providing a lipid phase containing water-binding organic lipophilic turbidity-inducing agents, wherein the lipid phase was subjected to at least one aqueous refining with a neutral or basic solution,
b) contacting an adsorption agent and/or a complexing agent with the lipid phase from step a),
c) separating the adsorbed or complexed water-binding organic lipophilic turbidity-inducing agents from step b) by means of a phase separation, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

A further embodiment according to the invention is a method for removing water-binding organic lipophilic turbidity-inducing agents from an aqueously refined lipid phase, characterized by a) providing a lipid phase containing water-binding organic lipophilic turbidity-inducing agents, wherein the lipid phase was subjected to at least one aqueous refining with a neutral or basic solution,
b) admixing the lipid phase from step a) with an adsorption agent and/or a complexing agent,
c) phase-separating and removing the adsorbed or complexed water-binding organic lipophilic turbidity-inducing agents, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

The provided turbid-substance-containing lipid phase must be subjected to at least one aqueous refining with a neutral to basic solution, so that a sufficient reduction of accompanying substances of the prepurified lipid phase is ensured. A neutral solution is understood to mean water. A basic solution means an aqueous solution having a pH greater than 7. Suitable for preparing an aqueous solution having a pH greater than 7 are salts which form carbonate ($CO_3^{2-}$), hydrogen carbonate ($HCO_3^-$), metasilicate ($SiO_3^{2-}$), orthosilicate ($SiO_4^{4-}$), disilicate ($Si_2O_5^{2-}$), trisilicate ($Si_3O_7^{2-}$) or borate ($BO_3^{3-}$) upon dissociation in water. Further preference is given to hydroxide compounds, especially with monovalent cations of the alkaline earth metals, such as sodium hydroxide and potassium hydroxide for example, but also other hydroxide compounds, such as ammonium hydroxide. In principle, it is possible to use any basic compound which dissociates in water and is known to a person skilled in the art.

A preferred embodiment of the method is the provision of a lipid phase in method step a), which phase has been subjected to at least one prepurification step with a basic and/or acidic solution.

Further preference is given to the provision of a lipid phase in which a largely complete reduction of phosphorus-containing compounds, alkaline earth metal ions and metal ions, and free acid groups has been achieved after an aqueous refining with a guanidine-group- or amidine-group-bearing compound.

The water-binding organic turbidity-inducing agents in the prepurified lipid phase are then contacted with an adsorption agent and/or complexing agent in step b). In this step, the water-binding organic lipophilic turbidity-inducing agents are adsorbed to suitable adsorption agents or can form complexes with certain ions, which complexes are largely water-insoluble, but can be separated into an aqueous phase owing to their complexity. Therefore, the method is completed by the separation of the adsorbed or complexed turbidity-inducing agents from step b) in step c) by phase separation; whereby the adhered or complexed water-binding organic turbidity-inducing agents can be separated together with the extractant to yield a low in turbidity-inducing agents and largely anhydrous lipid phase.

In one embodiment of the invention, according to any of the methods described herein, the at least one aqueous refining is carried out in step a) with an aqueous solution containing at least one guanidine-group- or amidine-group-bearing compound having a $K_{OW}$ of <6.3.

The designation $K_{OW}$ refers here to the partition coefficient between n-octanol and water.

The technical teaching and the examples show various embodiments of the aqueous refining methods understood in the context of step a) of the methods stated herein for attaining a lipid phase according to the invention.

A further substantial method feature consists in the provision of adhesion agents and complexing agents.

The use of cellulose products is a preferred embodiment for the inventive adsorption of hydrated water-binding organic turbidity-inducing agents. In this connection, preference is given to cellulose and hemicellulose. They can be in their natural chemical structure or chemically modified by bearing substituents. As possible examples, just a few may be mentioned here by name, such as carboxymethyl cellulose, hydroxyethyl cellulose, methyl hydroxyethyl cellulose, methyl hydroxypropyl cellulose, ethyl hydroxyethyl cellulose, hydroxypropyl cellulose, methyl cellulose. Cellulose ester compounds are preferred. Further preferred compounds are cellulose ethers. The form can be fibrous, crystalline or amorphous. The molecular weight is, in principle, freely selectable, but should preferably be within a range between 200 and 500 000 Da, more preferably between 1000 and 250 000 Da and most preferably between 2000 and 150 000 Da. The particle size is likewise freely selectable, though preference is given to particle sizes between 5 and 10 000 μm, more preferably between 20 and 5000 μm and most preferably between 50 and 500 μm.

In principle, other sugar-containing compounds are also suitable as adsorption substances according to the invention; these include hexoses or pentoses having β-1,4-glycosidic bonds, such as, for example, chitin, callose, or hexoses or pentoses having α-1,4-glycosidic bonds, starch such as amylose.

Furthermore, complex structures of the stipulated compounds are also possible, as are combinations thereof.

These biopolymers are also advantageous because they can be removed very easily from the lipid phases by various methods from the prior art, such as sedimentation, centrifugation or filtration. In this connection, it is additionally advantageous that, after a removal from the lipid phase, triglycerides are barely concomitantly removed. On the other hand, practically no cellulose remains in the lipid phase. A further advantage of such an adsorptive removal of the hydrated water-binding turbidity-inducing agents is that they can be extracted and separated under mild process conditions and are therefore in principle present in a chemically and structurally unaltered form and can be made accessible to a further utilization.

Furthermore, it was possible to achieve very good amelioration results with polyaluminum hydroxychloride sulfate. Therefore, the present invention also provides methods using polyaluminum hydroxychloride salts.

Accordingly, the invention provides for the use of the presently described methods for removing and for obtaining water-binding organic lipophilic turbidity-inducing agents.

In a preferred embodiment, the lipid phases containing hydrated water-binding organic turbidity-inducing agents are provided at a temperature between 10 and 60° C., more preferably between 15 and 50° C. and most preferably between 20 and 40° C.

In a preferred embodiment, a lipid phase is dried at a temperature of <40° C.

The amount of the extractable hydratable organic turbidity-inducing agents can vary depending on the application, as can the adsorption capacity of the adsorbent used. Therefore, it is necessary to ascertain for each application both the amount of the adsorbent (cellulose, cellulose derivatives and other saccharide-containing compounds, as disclosed herein) required for ameliorating a refined lipid phase, and the required time for leaving the adsorbent in the prepurified lipid phase. Preferably, the metered addition of the adsorbent in relation to the lipid phase is of <5% by weight, more preferably of <3% by weight and most preferably of <1% by weight. Furthermore, preference is given to an adsorption time of from 1 minute to 12 hours, more preferably between 5 minutes and 8 hours and most preferably between 10 minutes and 3 hours. The cellulose compounds are preferably introduced by stirring in using a propeller stirrer with light agitation of the lipid phase until a completely homogeneous distribution has been achieved in the lipid phase. Since the time required for this purpose can naturally vary, it is necessary to ascertain the required time for this purpose. The time for the stirring-in process is included in the adsorption time and should amount to a proportion thereof of <20%. The cellulose compounds are preferably immediately removed following the required adsorption time. This can be done by sedimentation, centrifugal separation, or filtration. Preference is given to a filtration; the devices and filters required for this purpose are known to a person skilled in the art.

In a further embodiment, an optimal hydration of the water-binding organic turbidity-inducing agents, i.e., binding of water molecules to the organic turbidity-inducing agents or formation of a water shell, following one or more aqueous refining processes is obtained by carrying out an aqueous refining step with an aqueous solution containing a dissolved guanidine-group- or amidine-group-bearing compound.

In a preferred embodiment, the hydration of water-binding organic turbidity-inducing agents is achieved by an aqueous refining step with a solution containing guanidine-group- or amidine-group-bearing compounds. In this case, preference is given to a quantity ratio between the lipid phase and the aqueous phase containing dissolved guanidine-group- or amidine-group-bearing compounds of 10:1, more preferably of 10:0.5 and most preferably of 10:0.1. Preference is given to an intensive-mixing-based introduction using a rotor-stator mixing system. The terms "homogenize", "disperse", "intensive introduction", "introduce intensively", "intensive mixing" and "intensive-mixing-based introduction" are used substantially synonymously here and refer to the homogenization of oil with an aqueous solution. The method of homogenizing lipid phases which not only contain carboxylic acids but also other organic compounds not corresponding to a neutral fat or an apolar solvent leads to a very advantageous and effective concomitant output of these compounds into the aqueous phase, in which carboxylic acids are present dissolved in a nanoemulsive manner. Intensive-mixing systems and methods are known from the prior art, such as, for example, rotor-stator systems, colloid mills, high-pressure homogenizers or ultrasonic homogenizers. This preferred intensive-mixer-based introduction is preferably carried out over a period of from 1 to 20 minutes, more preferably between 2 and 10 minutes and most preferably between 3 and 5 minutes. In this connection, the temperature of the lipid phase is preferably between 10 and 60° C., more preferably between 15 and 50° C. and most preferably between 20 and 40° C. Preference is given to an immediately subsequent centrifugal phase separation, which is carried out for preferably <10 minutes, more preferably <7 minutes and most preferably <5 minutes.

Depending on the particular application, the inventive extraction of hydrated water-binding organic turbidity-inducing agents of aqueously refined lipid phases can be carried out using a pulverulent formulation of the adsorption agents and preferably of cellulose compounds or of kaolin. In this connection, the adsorption agent can be added to the prepurified lipid phase, or the lipid phase can be added to the adsorption agent.

In one embodiment, it is also possible to use a solid and non-ionically soluble inorganic compound as adsorption agent. Phyllosilicates are suitable for the inventive adsorption of hydrated water-binding organic turbidity-inducing agents. In this case, particular preference is given to clay minerals, such as, for example, montmorillonite, chlorites, kaolins, serpentine. Particular preference is also given to aluminum-containing silicate compounds. They are naturally especially advantageous because they are available on a large scale and have no toxic effects owing to their physical structure. In one embodiment, preference is given to the use of phyllosilicates having an aluminum fraction of >25% by weight, more preferably of >30% by weight and most preferably of >40% by weight. In this case, the preferred form of application is a microcrystalline powder. Particular preference is given to kaolin. Further preference is given to a microcrystalline powder form of the kaolin. The amount of the powders of the inorganic compounds is guided by the specific adsorption capacity. Preference is given to a quantity ratio (g/g) of the powdered absorbent to the prepurified lipid phase of <0.03:1, more preferably of <0.01:1 and most preferably of <0.001:1. In this case, the temperature of the lipid phase is preferably between 10 and 60° C., more preferably between 15 and 50° C. and most preferably between 20 and 40° C. Preference is given to an immediately subsequent centrifugal phase separation, which is carried out for preferably <10 minutes, more preferably <7 minutes and most preferably <5 minutes. Further preference is given to a removal by means of a filtration.

In a preferred embodiment of method step b), use is made of phyllosilicates having an aluminum fraction of >25% by weight for the adsorption of hydrated organic turbidity-inducing agents. Preferably, the metered addition of the silicates according to the invention is of <5% by weight, more preferably of <3% by weight and most preferably of <1% by weight. Furthermore, preference is given to an adsorption time of from 1 minute to 12 hours, more preferably between 5 minutes and 8 hours and most preferably between 30 minutes and 3 hours. The silicate compounds are preferably introduced by stirring in with a propeller stirrer with light agitation of the lipid phase until a completely homogeneous distribution has been achieved. Since the time required for this purpose can naturally vary, it is necessary to ascertain the required time for this purpose. The time for the stirring-in process is included in the adsorption time and should amount to a proportion thereof of <20%. The silicate compounds are preferably immediately removed following the required adsorption time. This can be done by sedimentation, centrifugal separation, or filtration. Preference is given to a filtration; the devices and filters required for this purpose are known to a person skilled in the art.

In a further embodiment of the method according to the invention, an extraction of hydrated water-binding organic turbidity-inducing agents from the organic matrix is achieved by the complexing thereof.

This object is achieved by the provision and introduction of compounds in ionic form from the group of the cations from the group of the transition metals, metalloids and the metals.

In a preferred embodiment, an extraction of hydrated organic turbidity-inducing agents is achieved by a complexing with cations from the group of the transition metals, metalloids and the metals.

In this connection, complexing refers to the formation of a complex or multiple complexes or coordination compounds. Thus, a complexing of a hydrated water-binding organic turbidity-inducing agent is to be understood to mean the binding of said turbidity-inducing agent to a metal or transition metal, as disclosed herein, in the form of a coordination compound or complex. In this case, the intermolecular interactions leading to complexing can be caused by physicochemical binding energy forms, such as hydrogen bonds and van der Waals interactions, or by a chemical interaction which leads to a covalent bond. The resulting complex can, either as such or through an aggregation with other complexes, be separated from the organic phase by a physical separation method, such as a centrifugal or a filter-based separation method.

Very particularly suitable for this purpose is an aqueous solution containing aluminum chloride that is introduced by means of a mixing process into the aqueously refined lipid phase containing hydrated water-binding turbidity-inducing agents, leading to a complexing or aggregate formation, the separation of which can be easily achieved by a spontaneous phase separation, a sedimentation, a centrifugation or a filtration. However, also advantageous is the provision of an aqueous solution in which calcium, magnesium, iron, copper or nickel are present in ionized form. Preferably, aluminum or iron(III) ions are present.

The counterions are, in principle, freely selectable; however, preference is given to salts with sulfate, sulfide, nitrate, phosphate, hydroxide, fluoride, selenide, telluride, arsenide, bromide, borate, oxalate, citrate, ascorbate. Very particular preference is given to salts with chloride and sulfates. However, the anions should be highly hydrophilic so that they remain in the aqueous phase. The solutions should consist of otherwise low-ion or ion-free water, in which the preferably used cations are present in a molar concentration between 0.001 and 3, more preferably in a molar concentration from 0.1 to 2 and most preferably between 0.5 and 1. The aqueous solution volume used is, in relation to the prepurified lipid phase, <10% by volume, more preferably <5% by volume and most preferably <1.5% by volume. The introduction is preferably achieved by a rapid pouring-in. The mixing with the lipid phase is preferably achieved using a rapidly rotating propeller or foam-stirring instrument with a turbulent mixing-based introduction. However, it is also possible to use intensive-mixing methods as described herein. Since the time required for this purpose can naturally vary, it is necessary to ascertain the required time for this purpose. Preference is given to a mixing-based introduction of from 1 to 60 minutes, more preferably between 5 and 45 minutes and most preferably between 10 and 20 minutes. Furthermore, preference is given to a complexing time of from 1 minute to 5 hours, more preferably between 5 minutes and 3 hours and most preferably between 10 minutes and 1 hour.

In this case, the temperature of the lipid phase must preferably be set to values between 10 and 60° C., more preferably between 15 and 50° C. and most preferably between 20 and 40° C. Preference is given to an immediately subsequent centrifugal phase separation, which is carried out preferably for a period of <10 minutes, more preferably <7 minutes and most preferably <5 minutes. However, a separation of the phases can also be achieved by a sedimentation-based phase separation or a filtration. Further preference is given to a removal using a separator.

Therefore, the invention provides a method in which a sedimentation-based, centrifugal, filtration-based or adsorptive separation technique is carried out in step c).

In a further embodiment of the method according to the invention, the separation according to step c) is carried out by a sedimentation-based, centrifugal or filtration-based or adsorptive separation technique or by centrifugation or filtration.

The complexed and separated turbidity-inducing agents can be easily separated from the otherwise unaltered aqueous solutions containing the alkaline earth metal ions or metal ions by means of a filter and quantified. In this embodiment, the extraction and separation of the water-binding organic turbidity-inducing agents is possible practically without any loss of triglycerides.

In a preferred embodiment, the extraction and separation of hydrated organic turbidity-inducing agents is achieved without any product loss of a triglyceride mixture.

Another aspect of the invention is that, as a result of the adsorption and also the complexing of organic turbidity-inducing agents, they can be separated from the lipid phase together with the water molecules bound thereto. This has the enormous advantage that the hydrated water-binding turbidity-inducing agents and the bound water can be removed from a lipid phase in one method step.

In a particular embodiment, a lipid phase containing hydratable turbidity-inducing agents is dried by means of an adsorption and separation and/or complexing and separation of the hydratable turbidity-inducing agents together with the bound aqueous phase.

It was possible to demonstrate that lipid phases which had been treated by a refining method described herein and then had a turbidity and also a water content of less than 1.0% by weight subsequently had a clear to brilliant appearance as a result of the methods according to the invention relating to the adsorption and separation or complexing and separation of turbidity-inducing agents. This is caused by a reduction in the residual moisture content present in the thus refined lipid phases, which content is reduced by at least >75% by weight, more preferably by at least >85% by weight and most preferably by at least >95% by weight, in comparison with the starting value before the introduction of the adsorption or complexing agents. Furthermore, the residual moisture is lowered preferably to less than 0.5% by weight, more preferably to less than 0.01% by weight, and most preferably to less than 0.008% by weight. This can be easily tested using methods from the prior art, such as, for example, the Karl Fischer titration. Since a sufficient depletion of accompanying fat substances can already be achieved in a product-specific manner for lipid phases which had been treated with a single-step or multistep aqueous refining method in which a solution containing guanidine-group- or amidine-group-bearing compounds was used in at least one of the method steps, it is possible to immediately use the lipid phases after a removal of the water-binding turbidity-inducing agents and the drying of the lipid phases achieved thereby, for example as cooking oil, as cosmetics oil, as lubricating or hydraulic oil or as fuel. The reduction in the residual moisture that is achievable by the method causes further extremely advantageous effects:

- no heating or vacuum treatment of the lipid phase
- simple process technology with low production costs
- short treatment time under conditions gentle to the product
- obtaining an immediately usable product Therefore, the invention provides methods for drying refined lipid phases in a cost-effective manner and in a manner gentle to the product.

Therefore, one invention provides a method, wherein a lipid phase having a water content of less than 0.5% by weight is obtained after step c).

However, the removal of the water-binding turbidity-inducing agents yields yet further advantages. It was possible to document that the water-binding capacity of a lipid phase which with a method described herein for aqueous refining in which a refining with a solution containing guanidine-group- or amidine-group-bearing compounds had been performed in at least one of the method steps, as a result of a removal of water-binding organic turbidity-inducing agents by means of one of the methods disclosed herein, is distinctly reduced with respect to other methods used to dry the lipid phases after such a refining.

The capacity for water uptake, is herein also referred as "water reuptake capacity" or "water-binding capacity".

Water reuptake capacity is understood here to mean the capacity for binding of water in a lipid phase, which binding can be caused by a mixing-in process and leads to a retention of water in the lipid phase. Water reuptake capacity can be checked by means of a water-introduction method. In said methods, ion-free water is stirred into the lipid phase to be tested at a temperature of 25° C. This involves providing an aqueous volume fraction of 5% by volume with respect to the refined lipid phase and stirring with a stirring mixer at a speed of 500 rpm for 10 minutes. This is followed by a centrifugal phase separation at 6000 rpm for 10 minutes and the phases are separated from one another.

The value for the water reuptake capacity is the difference between the water content of a lipid phase after the water introduction and the lipid phase before the water introduction. According to the invention, preference is given to a water reuptake capacity of <40% by weight, more preferably of <15% by weight and most preferably of <5% by weight.

Furthermore, the method according to the invention for ameliorating lipid phases was assessed by comparing the water reuptake capacity of the nonameliorated lipid phase with the ameliorated lipid phase. Preference is given to a difference between the two lipid phases of >75%, more preferably of >85% and most preferably of >90%.

This result can be explained by an effective removal of water-binding turbidity-inducing agents from a lipid phase, which substances are then no longer available for a binding of water in the purified lipid phase.

Furthermore, the invention is related to the use of the methods described herein for reducing the water reuptake capacity in a refined lipid phase and/or for improving the oil shelf life or the oxidation stability of plant oil.

Besides the reduction in the water content and the ability of water to be introduced again, the transparency of the lipid phases is also improved in an especially advantageous manner as a result of the inventive adsorption method and the complexing method. For instance, refined lipid phases are obtained which contain hydratable organic compounds having a hydrodynamic diameter less than 100 nm in >90% of cases and greater than 200 nm in <5% of cases, determinable by an analysis of the light scattering at a phase boundary, such as the DLS method for example. Such lipid phases are optically brilliant.

Thus, the methods for adsorbing and separating and for complexing and separating water-binding organic turbidity-inducing agents also make it possible to obtain an optically brilliant oil phase.

The removal of water-binding turbidity-inducing agents with the resulting reduction in the water-binding capacity of the lipid phase obtained causes further extremely advantageous effects. In one aspect of the invention, this concerns effects which can occur during storage of the lipid phases obtained. During such a storage, lipid phases can come into contact with water molecules. In relation to this, simply a contact with air in which there is a water fraction is enough to allow an introduction of water molecules via organic molecules having a good water-binding capacity. Besides a thereby possible turbidity of the lipid phase, other effects important for storage stability can occur. In this connection, the unfavorable effects on the oxidative stability of a lipid phase must be mentioned first and foremost.

In lipid phases and especially in oils of plant and animal origin, there are variable amounts of unsaturated organic compounds, the main proportion being made up by unsaturated fatty acids. An exposure of these compounds to atmospheric oxygen, a temperature increase, high-energy radiation (e.g., UV light), contacting with catalysts, such as iron-nickel, free radicals, enzymes, such as lipoxygenases for example, or a basic environment can cause an oxidation at a double bond of an organic compound. In this connection, oxygen radicals are also catalyzed by organic compounds situated in a lipid phase, for example by chlorophylls, riboflavin or metal and heavy metal ions. This gives rise to hydroperoxides of the organic compounds. These are chemically unstable and decompose into secondary oxidation products. The decomposition releases free alkoxy radicals. Since, as stated above, the primary oxidation products are mostly unstable and are degraded further into secondary oxide compounds, it is meaningful to determine these reaction products in order to capture the long-term stability of a lipid phase. Suitable to this end is a reaction with para-anisidine, which reacts with secondary oxidation products such as aldehydes and ketones that are present in a lipid phase. The reaction product can be detected and quantified by spectrometric means (adsorption at 350 nm). Especially unsaturated aldehydes, which are frequently responsible for malodors in oils, are captured by the p-anisidine reaction. The p-anisidine value is closely correlated with the peroxide value measured in a lipid phase; in this respect, the presence of peroxides can be estimated by means of the p-anisidine test method. In this connection, the peroxide value specifies the number of primary oxidation products of a lipid phase and specifies the amount of milliequivalents of oxygen per kilogram of oil. Since there is a relatively high increase in the secondary oxidation products over time, the determination of p-anisidine value is better suited to determining storage stability. Therefore, oils ameliorated using a method according to the invention were tested for their storage stability under various conditions, the anisidine value being determined sequentially to estimate oxidative stability. Surprisingly, a reduction of oxidation products was obtained for lipid phases which had been ameliorated using the methods according to the invention, in comparison with lipid phases which were aqueously refined and in which, subsequently, either a vacuum-drying process was performed or a drying of the lipid phase with other compounds was carried out. This suggests that oxidation products were extracted and separated by the method according to the invention. This is all the more likely, given that, over a long period, there was a distinctly lower content of oxidation products for the lipid phases ameliorated according to the invention than for oils which had been treated with other substances or a vacuum-drying process. It is also possible to assume this owing to the fact that, in the case of an amelioration treatment in which there was no optimal reduction of turbidity-inducing agents by the compounds according to the invention, the storage stability had a tendency to be worse than in the case of an amelioration in which an optimal removal of the turbidity-inducing agents was achieved.

In the scientific literature, it was possible to demonstrate that there is a close connection between the development of secondary oxidation products and the formation of off-flavors and discolorings in a lipid phase. In line with these theoretical aspects arising from a removal of water-binding organic turbidity-inducing agents, it was found that the effects found for the amelioration method also affect storage stability with respect to a reduced development of off-flavors and of a discoloring. During a storage of lipid phases, substantially fewer abnormal flavorings were formed in ameliorated lipid phases compared to lipid phases which had otherwise been subjected to an identical pretreatment and a drying of the lipid phases which had subsequently been performed by other methods, as could be established in sensory tests with nonameliorated and ameliorated lipid phases which had been stored for at least 120 days. The formation of off-flavors correlated with the formation of secondary oxidation products, which, in the long-term studies, were formed to a considerably lower extent in lipid phases which had been ameliorated.

Therefore, the method for adsorbing and separating or complexing and separating water-binding organic turbidity-inducing agents is especially suitable for improving the sensory storage stability of lipid phases.

The method is therefore also directed to obtaining sensorily stabilized lipid phases. However, an oxidation of compounds situated in the lipid phase also promotes corrosive processes on materials which come into contact with such a lipid phase (e.g., tank system); therefore, efforts are made to carry out a storage under cooled conditions, with exclusion of light irradiation and with exclusion of air.

Thus, the method is preferably for obtaining a lipid phase low in turbidity-inducing agents in order to reduce oxidation damage to tank systems and technical equipment.

Another aspect of the reduction of the water reuptake capacity by a removal of water-binding turbidity-inducing agents concerns free-radical/oxidative changes which can lead to a discoloring.

Lipid phases which can be cleared of water-binding turbidity-inducing agents using the method according to the invention are lipid phases of biogenic origin that have a variable fraction of dyes. These are almost exclusively organic compounds which are completely apolar (e.g., carotenes) or contain only few polar groups, for example chlorophylls. Therefore, they pass over very easily into the lipid phase obtained, or are released from their structures thereby. The dye classes differ considerably in their chemical properties. However, many of these compounds have a distinct chemical reactivity or catalyze reactions, especially in the presence of a water fraction in the lipid phase or upon exposure to an ionizing radiation (e.g., UV light). In particular, oxidative processes can, via a Maillard reaction, give rise to compounds which lead to a discoloring and an off-flavor. For example, this applies to the formation of melanoidins, which are nitrogen polymers composed of amino acids and carboxylic acids, and lead to a brown color of the oil. Another example are tocopherols, which, for example, can be oxidized during a bleaching process (especially in the presence of an acid) and are precursors for color pigments forming over time. The discoloration of a refined oil is called "color reversion"; it occurs especially in corn oil. These dyes are especially chlorophylls and the derivatives thereof and degradation products such as, for example, pheophytin, but also flavonoids, curcumins, anthrocyanins, indigo, kaempferol and xanthophylls, lignins, melanoidins.

In line with the achieved improvement in storage stability with regard to the development of off-flavors, an improved color stability of the oils in which a removal of water-binding turbidity-inducing agents was performed was also found. In this connection, there was no development, or only a very slight development, of a discoloring (color reversion) over the course of at least 120 days.

Therefore, the method is also directed to the improved color stability during the storage of aqueously refined lipid phases in which a removal of water-binding turbidity-inducing agents has been carried out by adsorption and separation or complexing and separation.

The invention is directed to obtaining a lipid phase having a high color stability during a storage.

The present invention is therefore also directed to a removal of water-binding organic turbidity-inducing agents that is as complete as possible from a lipid phase after an aqueous refining. As shown by the technical teaching and the examples herein, the water reuptake capacity of a lipid phase after an inventive refining and amelioration of the lipid phase is so low that the storage stability is also increased as a result.

In a particularly preferred embodiment, the addition of the adsorption agents described herein or the contacting of one or more adsorption agents with the lipid phase is achieved by the adsorption agent(s) being present in a bound or complexed form, i.e., not as powder or microcrystalline. In this connection, in step b), an adsorption agent is used which is immobilized on or bound to a fabric or a texture or can form such a fabric or texture. In this case, "immobilized" means the application of the adsorption agent to the surface. "Fabric" is understood to mean a one- or multidimensional arrangement of thread and/or tape material linked or connected to one another, producing a planar or spatial structural composite (texture). A texture of the aforementioned materials gives rise to gaps which can be penetrable for liquids and/or corpuscular substances. The texture-forming materials can be of natural origin (e.g., of plant or animal origin, such as cotton or sheep's wool fibers) or of synthetic origin (e.g., PP, PET, PU, and many others). The surfaces of the texture materials must be chemically modified where applicable in order to immobilize the adsorption agents according to the invention thereto. The immobilization can be achieved by physical, physicochemical or chemical means. Methods relating thereto are known to a person skilled in the art.

A further preferred embodiment is the provision of bound or immobilized cellulose compounds. For example, this can be effected in the form of a complex texture material, of a plate or layer structure, for example as a nonwoven or filter plate or filter cartridge. In principle, an adsorptive removal by immobile silicates as described herein is also possible.

In a preferred embodiment, the lipid phase containing the hydrated water-binding organic turbidity-inducing agents is guided past the adsorption compounds or flows therethrough. This can be achieved by adding the texture/fabric to the lipid phase and contacting the lipid phase with the texture/fabric by agitation of the texture/fabric or the lipid phase in order to adsorb the turbidity-inducing agents. The adsorbed turbidity-inducing agents can then be separated from the lipid phase by a removal of the texture/fabric. In another embodiment, the lipid phase is guided through the texture/fabric penetrable for the lipid phase and flows therethrough. If the lipid phase is obtained after flowing through the texture/fabric as refined product, the adsorption and separation of the turbidity-inducing agents is done in one operation. To increase the efficiency of such a type of application, it may be useful to serially guide the lipid phase through multiple layers of the texture/fabric.

In another preferred embodiment, the texture consists of a packed bed of adsorption materials through which the turbid-substance-containing lipid phase is guided. This is a preferred embodiment in the use of cellulose compounds, since, depending on the polymer size and geometry, it allows a flow-through of a lipid phase even in the case of a dense packed bed of particles.

In a further preferred embodiment, complexing agents which have been immobilized on or bound to a fabric or texture are used in method step b). In this case, "immobilized" means the application of the complexing agent to the surface. The materials usable in this connection, and also the texture and structural composite thereof, can be effected with the same materials and fabrics as for the above-described materials and fabrics for an application using adsorption agents. This also applies to the use of these materials with immobilized complexing agents. Preference is given here to microparticles or nanoparticles having a large inner surface area, such as, for example, zeolites or silica gels, which have been loaded with the complexing agents and are provided in the form of a packed bed of the particles. As a result of the refined lipid phase containing hydrated turbidity-inducing agents being guided through, they are complexed with the immobilized complexing agents, and, as a result, they are separated from the lipid phase.

The invention provides a method, wherein the adsorption agent and/or the complexing agent of step b) has been immobilized or bound in a fabric or in a texture, the fabric or the texture being suited to a complexing and/or adsorption and/or filtration of the turbid-substance-containing lipid phase.

In a further preferred embodiment, the complexing-agent-containing solutions already used according to the invention and also the adsorption agents used according to the invention can be reused. In practical use, it has become apparent that, in the aqueous phases containing the dissolved complexing agents, the complexed and separated turbidity-inducing agents are present in the form of particles.

These macroscopically visible aggregates floated to the aqueous phase and could be completely removed from the otherwise clear aqueous phase by a filtration (screening size 2 μm). Microscopically, it was possible to identify crystal-type structures. A disruption of the aggregates in order to analyze the compounds present therein has so far not been carried out. It has become apparent that, in the case of a reuse of the filtration-purified aqueous phase still containing complexing agents, there is a reduction in the hydrated organic turbidity-inducing agents for a renewed use, as was the case for the first use.

Another aspect of the method concerns the only minimal or nonexistent product loss of the purified lipid phase.

The aqueous phases used according to the invention with complexing agents dissolved therein were only slightly turbid to brilliant after a centrifugal removal of the lipid phase and did not have any solids therein, except for the above-described aggregates; there was also no formation of emulsion in any case. In relation to the oil phase, there was always a sharp phase boundary, and so separators are highly suitable and preferred for the separation of the aqueous phase containing dissolved complexing agents. It was possible to achieve the separation of the complexed organic turbidity-inducing agents without product loss.

After the adsorption of organic turbidity-inducing agents, it was possible for the tested adsorption agents which were mixed into the lipid phases to be separated by means of centrifuges and decanters to give compact masses. The analysis for triglyceride compounds situated therein showed that they are outputted with the separated adsorption agent mass only to a very slight extent. In this case, the product loss is <0.2% by weight, based on the mass of the lipid phase.

Preference is given to an adsorption and separation and/or complexing and separation of hydrated organic turbidity-inducing agents with a low product loss or with no product loss and also to a drying of lipid phases that is low in product loss or free of product loss.

Another aspect of the method is directed to obtaining separated organic turbidity-inducing agents and to the reusability of the adsorption and complexing agents used according to the invention. It was possible to show that the organic turbidity-inducing agents separated with the adsorption agents can be removed from the adsorption agents. This can be achieved with polar and nonpolar solvents known from the prior art. Since the organic turbidity-inducing agents can be different compounds or compound classes, the selection of a suitable solvent or solvent mixture must be oriented thereto. It may also be advisable to perform sequential detachment of the adsorbed organic turbidity-inducing agents. For instance, it has become apparent that, when firstly a removal of concomitantly outputted neutral fats is effected by means of an apolar solvent such as n-hexane for example, it is possible to remove and fractionate compounds such as phospholipids in a further wash step with a polar solvent, for example methanol. Other examples are extractions which were carried out with ethyl acetate, in which yellow dyes were obtained, or effected with chloroform; found in this organic phase were, inter alia, chlorophylls. It was possible to obtain yet further fractions using diethyl ether and alcohols, with organic compounds such as vitamin A, tocopherol, styrene glycosides, squalenes and glycero-glycolipids being found. However, in some experiments, relevant amounts of free fatty acids and also wax acids and waxes were also extracted. This was especially the case when there was still a relatively high fraction of free fatty acids (>0.2% by weight) in the oil phase containing hydrated organic turbidity-inducing agents that was present after an aqueous refining.

Adsorption agents used and separated according to the invention that were treated with at least one nonpolar and at least one polar solvent in a solvent amount suitable for the complete uptake of detachable organic turbidity-inducing agents or concomitantly outputted neutral fats can subsequently be initially obtained as a fraction by known methods by means of filtration, sedimentation or by a centrifugal separation method and then recovered in a pulverulent form by drying methods. It was possible to show that, in the case of a renewed use of for example hydroxyethyl cellulose and kaolin in lipid phases containing hydrated organic turbidity-inducing agents, these lipid phases are purified from the turbidity-inducing agents in a similar manner as for the first use of the adsorption agents. Therefore, methods for removing and fractionating separated organic turbidity-inducing agents and purification methods for the adsorption agents used according to the invention are provided which allow a renewed inventive use of the adsorption agents. Therefore, firstly, the separated organic compounds can be obtained and provided for a further use and, secondly, the adsorption agents can be reused. This makes the method especially attractive from an economical point of view, and saves resources.

A particularly preferred embodiment consists in removing and obtaining organic turbidity-inducing agents separated by means of adsorption.

Preference is given to the provision of purified adsorption agents and solutions containing complexing agents.

Preference is also given to the use of separated organic turbidity-inducing agents.

Furthermore, preference is given to the recovery of neutral fats which were outputted by complexing and/or adsorption agents.

Methods

Method for Preparing an Aqueous Emulsion according to Method Step a):

In one embodiment of the present invention, a prepurification of a lipid phase is performed before the refining of the lipid phase with a solution containing guanidine- and/or amidine-group-bearing compounds, by admixing water or an aqueous solution having a preferred pH range between 7.0 and 14, more preferably between 9.5 and 13.5 and most preferably between 11.5 and 13.0 and, after mixing with the lipid phase, obtaining a prepurified lipid phase by means of a preferably centrifugal phase separation. In a further embodiment, the aqueous solution contains for the purposes of prepurification a base preferably selected from sodium hydroxide, potassium hydroxide, ammonium hydroxide, sodium carbonate, sodium hydrogen carbonate, sodium bicarbonate, potassium carbonate and potassium hydrogen carbonate, sodium metasilicate, sodium borate.

In a further embodiment, the prepurification of the lipid phase is carried out analogously to the basic prepurification by means of an acid in concentrated form or by means of an aqueous solution of an acid. In this case, the prepurification is carried out by admixing the undiluted acid or an acid-containing aqueous solution having a pH between 1.0 and 5, more preferably between 1.7 and 4 and most preferably between 3 and 3.5 with the lipid phase and, after phase separation, removing the aqueous (heavy) phase. For the adjustment of pH, preference is given to acids and particular preference is given to an acid selected from phosphoric acid, sulfuric acid, citric acid and oxalic acid.

The appropriate concentrations and the mixing ratio of the aqueous phases usable for the prepurification to the oil phase are, in principle, freely selectable and can be easily worked out by a person skilled in the art. Preference is given to concentrations of the basic solutions between 0.1 to 3 molar, more preferably between 0.5 and 2 molar and most preferably between 0.8 and 1.5 molar. The volume ratio between the basic aqueous phase and the oil phase should be preferably between 0.3 to 5% by volume, more preferably between 0.3 and 4% by volume and most preferably between 1.5 and 3% by volume.

Acids can be added in undiluted form or as an aqueous acid solution to the lipid phase. The undiluted acid is preferably added in a volume ratio between 0.1 and 2.0% by volume, more preferably between 0.2 and 1.0% by volume and most preferably between 0.3 and 1.0% by volume. The aqueous acid solution is preferably added in a volume ratio between 0.5 and 5% by volume, more preferably between 0.8 and 2.5% by volume and most preferably between 1.0 and 2.0% by volume.

The introduction of the basic and acid-containing solutions for the purposes of prepurification can be carried out continuously or batchwise and the mixing of the two phases using stirring instruments from the prior art or using an intensive mixer (e.g., rotor-stator dispersers), provided this does not lead to an emulsion that is no longer separable by physical methods. The goal of the prepurification is to remove easily hydratable mucilage from the lipid phase.

The exposure time for applications in a batch method lies between 1 to 30 minutes, more preferably between 4 and 25 minutes and most preferably between 5 and 10 minutes. In the case of application of a continuous mixing (so-called inline method), the residence time in the mixer is between 0.5 seconds to 5 minutes, more preferably between 1 second and 1 minute and most preferably between 1.5 seconds to 20 seconds. The preferred temperatures which the lipid phase and the admixed aqueous phase should have for an intensive mixing is between 15° C. and 45° C., more preferably between 20° C. and 35° C. and most preferably between 25° C. and 30° C. The removal of the aqueous phase from the emulsion can preferably be carried out by centrifugal separation methods; preference is given to the use of centrifuges, separators and decanters. In this case, the duration of a centrifugal removal is dependent on the product-specific parameters (water fraction, viscosity, and many others) and the separation method used and must therefore be ascertained on an individual basis. Preferably, a centrifugation must be carried out for from 2 to 15 minutes, more preferably for from 8 to 12 minutes. Residence in a separator or decanter is preferably from 2 to 60 seconds, more preferably from 10 to 30 seconds. The centrifugal acceleration must preferably be selected between 2000 and 12 000 g; further preference is given to a centrifugal acceleration between 4000 and 10 000 g. The temperature during a phase separation should preferably be between 15 and 60° C., more preferably between 20 and 45° C. and most preferably between 25 and 35° C.

The effectiveness of the prepurification can be ascertained by the determination of the phosphorus content and of the amount of mucilage present in the lipid phase to be refined. Lipid phases containing less than 100 ppm phosphorus and less than 0.5% by weight of unhydrolyzable organic compounds are appropriate. However, lipid phases beyond these characteristic numbers can also be refined with solutions containing guanidine- and/or amidine-group-bearing compounds. If there is the need for a prepurification, the selection of an aqueous degumming method, i.e., a treatment with an acid (in undiluted form or as aqueous solution) or an alkaline solution, is, in principle, freely selectable, yielding various prepurification options: I. single acid treatment, II. single base treatment, III. first acid treatment, then base treatment, IV. first base treatment, then acid treatment, V. repeated acid treatment, VI. repeated base treatment. The selection of the appropriate and most cost-effective method can be done by a person skilled in the art without any problems. However, from practical experience, it has been found that, if a prepurification is required, the initial application of an aqueous acid treatment followed by, if additionally required, an aqueous base treatment represents the most preferred embodiment.

However, the technical teaching herein also shows that the inventive removal method of water-binding organic turbidity-inducing agents from a biogenic lipid phase greatly depends on whether the lipid phase has been initially cleared of hydratable organic and inorganic fractions and corpuscular fractions by means of aqueous extraction steps in order to thereby make a hydratability of lipophilic water-binding organic turbidity-inducing agents possible. It became apparent that the number and order of the refining steps is, in principle, unimportant, provided a neutral to basic compound is used in the last refining step. In this case, it is especially advantageous when said basic compound contains one or more guanidine and/or amidine groups. Therefore, an aqueous refining method with an aqueous solution containing compounds having a guanidine or amidine group represents an essential feature for the provision of a hydrated form of water-binding turbidity-inducing agents. In this hydrated form, it is extremely advantageously possible for the water-binding organic lipophilic turbidity-inducing agents to be adhered or complexed without any relevant concomitant removal of apolar lipid constituents and especially not of triglycerides.

The lipid phases suitable for use in method step a) have passed through at least one aqueous refining step with a basic solution followed by a phase separation which is preferably achieved by means of a centrifugal separation technique. In this case, the time interval between the refining and the use of the method according to the invention is, in principle, unimportant. It is preferred that said method is carried out immediately after the refining. The residual moisture present in the lipid phase is, in principle, unimportant, though a better hydration of the water-binding organic turbidity-inducing agents causes a better extractability of the same. Preference is given to residual water contents between 10.0 and 0.001% by weight, more preferably between 5.0 and 1.0% by weight and most preferably between 2.0 and 1.2% by weight. It is intended that the pH present in the lipid phase be preferably between 6 and 14, more preferably between 8 and 13 and most preferably between 8.5 and 12.5. The temperature of the lipid phase is, in principle, freely selectable; in the case of viscous lipid phases, it may be necessary to warm them in order to make them more flowable and to improve the introducability of the complexing or adsorption agent.

Method for Process Control and Monitoring:

The selection of an adhesion or complexing agent is, in principle, freely selectable. Nevertheless, the most suitable complexing or adsorption agent must be individually determined. For some applications, it may be advantageous to use adsorption agents, since they have, for example, an authorization for use as food. Also, the effectiveness of the adsorption and complexing agents according to the invention may vary for different lipid phases. If there is a preference for hydrated turbidity-inducing agents to be discharged as gently as possible, it may again be advantageous to use adsorption agents, which are subsequently further purified. For extensive exclusion of a product output by contrast, solutions containing complexing agents are advantageous.

The complexing agents are dissolved in dissociated form in a preferably low-ion or otherwise ion-free water. The complexing agents are preferably used singly in a salt form. However, combinations of the compounds are also possible. In this connection, the amounts and concentration ratios are freely selectable. The solutions with complexing agents contained therein can be applied continuously or in the form of a single addition. Preference is given to an automated application. In this case, the method can be carried out as a batch or so-called inline method. In the case of an inline method, a continuous mixing-in is preferably carried out, preferably using an intensive mixer. The reaction mixture can then be conveyed by means of a piping system or by means of inlet systems into a reservoir for the required reaction time. In the case of a batch method, the reaction solution remains in the corresponding reactor vessel. The aforementioned concentrations, volume ratios, temperatures are preferably to be complied with in this case. The mixing in a batch reactor should be carried out as described above. The adsorption agents are preferably to be added in powdered form to the lipid phase. This can be done in the form of a single addition or in the form of fractionated or continuous additions. Preference is given to an automated dispensing process. The mixing can be carried out as described for the complexing agents, though preference is given to a stirring-based introduction with a turbulent mixing-based introduction. Furthermore, preference is given to batch reaction procedures.

The amount of the volume addition for a particular concentration of complexing agents or adsorption agent and the minimum time which are required in order to achieve a sufficient complexing or adhesion of the hydrated organic lipophilic turbidity-inducing agents can be easily worked out by means of an experiment (e.g., experimental procedure as per example 6). Exemplarily, this can be investigated on a small volume of a refined lipid phase; the determined volume and concentration ratios and also the ascertained time can be easily transferred to industrial-scale batches. The required product specification is tested by removal of a sample (e.g., 100 ml), for which a centrifuge is used (4000 rpm, 5 minutes) to carry out a phase separation. The supernatant oil fraction can then be tested for the water content. The required reduction of water-binding turbidity-inducing agents is present when the residual moisture content contained therein is reduced by at least >75% by weight, more preferably by at least >85% by weight and most preferably by at least >95% by weight, in comparison with the starting value present before the introduction of the adsorption or complexing agents. Furthermore, the residual moisture is lowered preferably to less than 0.5% by weight, more preferably to less than 0.01% by weight, and most preferably to less than 0.008% by weight. This can be easily tested by means of methods from the prior art, such as, for example, by means of Karl Fischer titration. A further product specification is the water reuptake capacity of the oil fraction obtained. This can be tested by stirring in ion-free water at a temperature of 25° C. This involves providing an aqueous volume fraction of 5% by volume with respect to the refined lipid phase and stirring with a stirring mixer at a speed of 500 rpm for 10 minutes. This is followed by a centrifugal separation at 6000 rpm for 10 minutes. The product specification is attained when the water reuptake capacity of the ameliorated lipid phase is reduced by >75% compared with the nonameliorated lipid phase.

Furthermore, a sufficient product specification is present when the lipid phase only contains compounds, its hydrodynamic diameter of which is less than 100 nm in >90% of all particles contained therein and greater than 200 nm for <5%, determinable by means of an analysis of the light scattering at a phase boundary, such as, for example, the DLS method. Such lipid phases are optically brilliant.

A minimum prerequisite for the inventive performance of a complexing and separation or adsorption and separation of hydrated turbidity-inducing agents is met when at least one of the aforementioned product specifications is present.

A special case and preferred embodiment of the inventive extraction and subsequent separation of turbidity-inducing agents is a combination of an extraction and a separation of turbidity-inducing agents, as described herein. This special case occurs when one or more of the adsorption and/or complexing agents are immobilized on/at a support material. If such loaded support materials are added to a lipid phase containing hydrated turbidity-inducing agents, and/or such lipid phases are guided through the loaded support material, which should preferably have a porous or mesh-type structure, an extraction of the hydrated turbidity-inducing agents can take place by adsorption or complexing directly on the separation medium, which can be subsequently easily removed from/out of the lipid phase.

Separation Methods, Methods for Carrying Out Method Step c):

The term "centrifugal phase separation", as used here, refers to a separation of phases by utilization of a centrifugal acceleration. It encompasses in particular methods known to a person skilled in the art, such as the use of centrifuges and preferably of separators. The separation methods are suited both to the phase separation for the aqueous refining steps disclosed herein, and to a separation of the adsorption or complexing agents claimed herein. A further centrifugal separation method is provided by decanters.

Since the lipid mixtures which have been admixed with an aqueous phase or with an adsorption agent or a complexing agent are, in principle, two phases having differing density, a phase separation is, in principle, also possible by sedimentation. Experience shows that the organic compounds which are to be removed and which have been transferred to an aqueous phase or have been aggregated or complexed as turbidity-inducing agent cannot for the most part be spontaneously separated, and so the separation efficiency and speed must be increased by means of pulling and compressive forces. According to the prior art, this is easily possible by means of a simple centrifuge or a separator suitable for this purpose. Application of pressure or negative pressure is possible too. Separators are systems in which synchronous or nonsynchronous plates or disks create corresponding pulling forces besides a simultaneous pressure build-up. The advantage in the case of the use of separators is that they make it possible to carry out a continuous phase separation. Therefore, a particularly preferred embodiment for the phase separation of lipid phases is carrying out the phase separation using a separator.

In the case of the preferred phase separation by means of a separator, preference is given to systems having a throughput volume of more than 3 $m^3$/h, more preferably >100 $m^3$/h and most preferably >400 $m^3$/h.

The separation of the aqueously refined lipid phases can, in principle, take place immediately after completion of a mixing-based or intensive-mixing-based introduction. On the other hand, if required by the process sequence, the aqueously refined lipid mixture to be separated can firstly be collected in a reservoir tank. The duration of storage depends solely on the chemical stability of the compounds situated in the lipid phase and the process conditions. Preference is given to the phase separation immediately after an intensive-mixing-based introduction.

The temperature of the lipid mixture to be separated can, in principle, correspond to the temperature which was selected for production. However, it may also be advantageous to vary the temperature and to select a higher temperature when, for example, this increases the action of the separation tool, or a lower one, for example when this increases the extraction efficiency. In general, preference is given to a temperature range between 15° C. and 50° C., more preferably 18° C. to 40° C. and most preferably between 25° C. and 35° C.

The residence time in a separator or a centrifuge is substantially guided by the apparatus-specific properties. Generally, for economic performance, preference is given to a residence time in a separation device that is as short as possible; such a preferred residence time for a separator is <10 minutes, more preferably <5 minutes and most preferably <2 minutes. In the case of centrifuges, a preferred residence time is <15 minutes, more preferably <10 minutes and most preferably <8 minutes. The selection of the centrifugal acceleration depends on the density difference of the two phases to be separated and must be determined individually. Preference is given to acceleration forces between 1000 g and 15 000 g, more preferably between 2000 g and 12 000 g and most preferably between 3000 g and 10 000 g.

The water content of a lipid phase (also referred to as oil moisture) can be determined by various established methods. Besides other methods, such as IR spectroscopy for example, the Karl Fischer titration method is carried out in accordance with DIN 51777 as the reference method. Using this electrochemical method, in which the consumption of the water present in the lipid phase, as required for the chemical conversion of iodine to iodide, is determined via a color change, it is possible to detect even a minimum water content of as far as 10 μg/L (0.001 mg/kg).

Water Uptake Capacity of a Refined Lipid Phase and Testing Method

Water reuptake capacity is understood here to mean the capacity for binding water in a lipid phase, which can be brought about by a mixing-in process and lead to a retention of water in the lipid phase. This can be checked by stirring in ion-free water at a temperature of 25° C., involving providing an aqueous volume fraction of 5% by volume with respect to the lipid phase and stirring in with a stirring mixer at a speed of 500 rpm for 10 minutes. This is followed by a centrifugal separation at 3000 g for 10 minutes.

The value of the water reuptake capacity is the difference in the water content between a lipid phase after the introduction of water and the lipid phase before the introduction of water. According to the invention, preference is given to a water reuptake capacity of <40% by weight, more preferably of <15% by weight and most preferably of <5% by weight. Furthermore, the method according to the invention for ameliorating lipid phases was assessed by comparing the water reuptake capacity of the nonameliorated lipid phase with the ameliorated lipid phase. Preference is given to a difference between the two lipid phases of >75%, more preferably of >85% and most preferably of >90%.

The water content was determined with the same and herein-disclosed measurement method.

Aqueous Refining with Guanidine- and/or Amidine-Group-Bearing Compounds

The term guanidine- and/or amidine-group-bearing compounds is used here synonymously with the term guanidine and/or amidine compounds.

Suitable compounds are those having at least one guanidino group (also called guanidino compounds) and/or having at least one amidino group (also called amidino compounds). Guanidino group refers to the chemical radical $H_2N$—C(NH)—NH— and also the cyclic forms thereof, and amidino group refers to the chemical radical $H_2N$—C(NH)— and also the cyclic forms thereof (see examples below). Preference is given to guanidino compounds which have, in addition to the guanidino group, at least one carboxylate group (—COOH). Furthermore, it is preferred when the carboxylate group(s) are separated in the molecule by at least one carbon atom from the guanidino group. Preference is also given to amidino compounds which have, in addition to the amidino group, at least one carboxylate group (—COOH). Furthermore, it is preferred when the carboxylate group(s) are separated in the molecule by at least one carbon atom from the amidino group.

Said guanidino compounds and amidino compounds preferably have a partition coefficient $K_{OW}$ between n octanol and water of less than 6.3 ($K_{OW}$<6.3).

Particular preference is given to arginine, which can be present in the D- or L-configuration or as a racemate. Further preference is given to arginine derivatives. Arginine derivatives are defined as compounds which have a guanidino group and a carboxylate group or an amidino group and a carboxylate group, with guanidino group and carboxylate group or amidino group and carboxylate group being separated from one another by at least one carbon atom, i.e., at least one of the following groups being situated between the guanidino group or the amidino group and the carboxylate group: —$CH_2$—, —CHR—, —CRR'—, where R and R' are each independently any desired chemical radical. It is self-evident that the distance between the guanidino group and the carboxylate group or the amidino group and the carboxylate group can also be more than one carbon atom, for example in the case of the following groups —($CH_2$)n-, —(CHR)n-, —(CRR')n-, where n=2, 3, 4, 5, 6, 7, 8 or 9, as is the case, for example, for amidinopropionic acid, amidinobutyric acid, guanidinopropionic acid or guanidinobutyric acid. Compounds having more than one guanidino group and more than one carboxylate group are, for example, oligoarginine and polyarginine.

Preferred arginine derivatives are compounds of the following general formula (I) or (II)

(I)

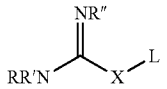

(II)

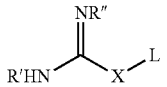

where

R', R'', R''' and R'''' are each independently: —H, —OH, —CH=$CH_2$, —$CH_2$—CH=$CH_2$, —C($CH_3$)=$CH_2$, —CH=CH—$CH_3$, —$C_2H_4$—CH=$CH_2$, —$CH_3$, —$C_2H_5$, —$C_3H_7$, —CH($CH_3$)$_2$, —$C_4H_9$, —$CH_2$—CH($CH_3$)$_2$, —CH($CH_3$)—$C_2H_5$, —C($CH_3$)$_3$, —$C_5H_{11}$, —CH($CH_3$)—$C_3H_7$, —$CH_2$—CH($CH_3$)—$C_2H_5$, —CH($CH_3$)—CH($CH_3$)$_2$, —C($CH_3$)$_2$—$C_2H_5$, —$CH_2$—C($CH_3$)$_3$, —CH($C_2H_5$)$_2$, —$C_2H_4$—CH($CH_3$)$_2$, —$C_6H_{13}$, cyclo-$C_3H_5$, cyclo-$C_4H_7$, cyclo-$C_5H_9$, cyclo-$C_6H_{11}$, —$PO_3H_2$, —$PO_3H^-$, —$PO_3^{2-}$, —$NO_2$, —C≡CH, —C≡C—$CH_3$, —$CH_2$—C≡CH, —$C_2H_4$—C≡CH, —$CH_2$—C≡C—$CH_3$, or R' and R'' together form one of the following groups: —$CH_2$—$CH_2$—, —CO—$CH_2$—, —$CH_2$—CO—, —CH=CH—, —CO—CH=CH—, —CH=CH—CO—, —CO—$CH_2$—$CH_2$—, —$CH_2$—$CH_2$—CO—, —$CH_2$—CO—$CH_2$— or —$CH_2$—$CH_2$—$CH_2$—;

X is —NH—, —NR''''—, —O—, —S—, —$CH_2$—, —$C_2H_4$—, —$C_3H_6$—, —$C_4H_8$— or —$C_5H_{10}$— or is a $C_1$ to $C_5$ carbon chain which can be substituted with one or more of the following residues: —F, —Cl, —OH, —$OCH_3$, —$OC_2H_5$, —$NH_2$, —$NHCH_3$, —NH($C_2H_5$), —N($CH_3$)$_2$, —N($C_2H_5$)$_2$, —SH, —$NO_2$, —$PO_3H_2$, —$PO_3H$—, —$PO_3^{2-}$, —$CH_3$, —$C_2H_5$, —CH=$CH_2$, —C≡CH, —COOH, —$COOCH_3$, —$COOC_2H_5$, —$COCH_3$, —$COC_2H_5$, —O—$COCH_3$, —O—$COC_2H_5$, —CN, —$CF_3$, —$C_2F_5$, —$OCF_3$, —$OC_2F_5$;

L means a hydrophilic substituent selected from the group consisting of:

—$NH_2$, —OH, —$PO_3H_2$, —$PO_3H^-$, —$PO_3^{2-}$, —$OPO_3H_2$, —$OPO_3H^-$, —$OPO_3^{2-}$, —COOH, —$COO^-$, —CO—$NH_2$, —$NH_3^+$, —NH—CO—$NH_2$, —N($CH_3$)$_3^+$, —N($C_2H_5$)$_3^+$, —N($C_3H_7$)$_3^+$, —NH($CH_3$)$_2^+$, —NH($C_2H_5$)$_2^+$, —NH($C_3H_7$)$_2^+$, —$NHCH_3$, —$NHC_2H_5$, —$NHC_3H_7$, —$NH_2CH_3^+$, —$NH_2C_2H_5^+$, —$NH_2C_3H_7^+$, —$SO_3H$, —$SO_3^-$, —$SO_2NH_2$, —CO—COOH, —O—CO—$NH_2$, —C(NH)—$NH_2$, —NH—C(NH)—$NH_2$, —NH—CS—$NH_2$, —NH—COOH.

In one embodiment, the preferably used concentration of guanidine or amidine compounds, which must be in dissolved form in a preferably low-ion or ion-free water, is determined on the basis of the determinable acid value of the lipid phase to be refined, which value can, for example, be determined by a titration with KOH. In this case, the deducible number of carboxyl groups is used to calculate the weight amount of the guanidine or amidine compounds. Here, an at least identical or higher number of guanidine or amidine groups, which are present in free and ionizable form, must be present. The thus determinable molar ratio between the guanidine-group- or amidine-group-bearing compounds and the entirety of the free or releasable carboxyl-group-bearing compounds or carboxylic acids must be >1:1. Preferably, a molar ratio between the determinable carboxylic acids (especially crucial here is the acid value) and the guanidine-group- or amidine-group-bearing compounds of 1:3, more preferably of 1:2.2 and most preferably of 1:1.3 should be established in an ion-free water. In this case, the molarity of the dissolved inventive solution containing guanidine-group- or amidine-group-bearing compounds can be preferably between 0.001 and 0.8 molar, more preferably between 0.01 and 0.7 molar and most preferably between 0.1 and 0.6 molar. Since the interaction of the guanidine or amidine groups is also ensured at ambient temperatures, the preferred temperature at which the inventive introduction of the aqueous solutions containing dissolved guanidine or amidine compounds can take place is between 10° C. and 50° C., more preferably between 28° C. and 40° C. and most preferably between 25° C. and 35° C. It is intended that the introduction of the aqueous solutions containing guanidine-group- or amidine-group-bearing compounds be preferably achieved by means of an intensive-mixing-based introduction. In this case, the volume ratio between the lipid phase and the aqueous phase is, in principle, unimportant. However, a preferred embodiment is a quantity ratio (v/v) of the aqueous solution to the lipid phase of from 10% by volume to 0.05% by volume, preferably of from 4.5% by volume to 0.08% by volume, more preferably of from 3% by volume to 0.1% by volume.

The volume ratio and concentration ratio may be influenced by the fact that, in some lipid phases, emulsion-forming compounds, such as glycolipids for example, may also be removed by an aqueous solution containing guanidine-group- or amidine-group-bearing compounds and, as a result, said compounds are not available for the removal of carboxylic acids. Therefore, it may be necessary in one embodiment to select a larger volume ratio and/or concentration ratio of the aqueous solutions containing guanidine-group- or amidine-group-bearing compounds to the lipid phases to be refined.

Suitable intensive mixers include especially those intensive mixers which operate according to the principle of high-pressure or rotor-stator homogenization.

An intensive mixing of the lipid phase and the aqueous phase then takes place in the intensive mixer. The intensive mixing takes place at atmospheric pressure and a temperature within the range of 10° C. to 90° C., preferably 15° C. to 70° C., more preferably 20° C. to 60° C. and especially preferably 25° C. to 50° C. Therefore, the mixing and preferably intensive mixing takes place at a low temperature of preferably below 70° C., more preferably of below 65° C., more preferably of below 60° C., more preferably of below 55° C., even more preferably of below 50° C., even more preferably of below 45° C.

Therefore, it is especially preferred when the entire aqueous refining method, preferably including the optional steps, is carried out at temperatures within the range of 10° C. to 90° C., preferably 13° C. to 80° C., preferably 15° C. to 70° C., more preferably 18° C. to 65° C., more preferably 20° C. to 60° C., more preferably 22° C. to 55° C. and especially preferably 25° C. to 50° C. or 25° C. to 45° C.

For the optional wash step using an aqueous solution having a basic pH, the pH range preferred for this purpose is between 7.0 and 14, more preferably between 9.5 and 13.5 and most preferably between 11.5 and 13. The introduction of the basic wash solution is preferably achieved by means of an intensive mixing process; particular preference is given here to rotor-stator mixers. In this case, the preferred action time is between 1 to 30 minutes, more preferably between 4 and 25 minutes and most preferably between 5 and 15 minutes. In this case, the preferred temperatures of the lipid phase are between 15° C. and 45° C., more preferably between 20° C. and 35° C. and most preferably between 25° C. and 30° C.

One embodiment of the pretreatment of the lipid phases to be purified by means of the aqueous refining consists in the pretreatment with an aqueous solution containing an acid and having a pH between 1 and 7, more preferably between 2.5 and 4 and most preferably between 3 and 3.5. In this case, preference is given to a mixing-in of the acid-containing solution by means of an intensive introduction as described herein; particularly preferred in this case are rotor-stator mixing systems. In this case, the preferred action time is between 1 to 30 minutes, more preferably between 4 and 25 minutes and most preferably between 5 and 10 minutes. In this case, the preferred temperatures of the lipid phase are between 15° C. and 45° C., more preferably between 20° C. and 35° C. and most preferably between 25° C. and 30° C. In this respect, the inventive removal of turbidity-inducing agents from a prepurified lipid phase is also directed to an especially advantageous low-loss refining of neutral lipids, and to the fact that less than 5 ppm, more particularly less than 2 ppm of phosphorus-containing compounds, less than 0.2%, more particularly less than 0.1% of free fatty acids, and less than 3 ppm, more particularly less than 0.02 ppm of Na, K, Mg, Ca and/or Fe ions are contained therein.

In other words, the inventive removal of turbidity-inducing agents from a prepurified lipid phase is also directed to an especially advantageous low-loss refining of neutral lipids, and to the fact that less than 5 ppm (or 5 mg/kg), more particularly less than 2 ppm (mg/kg) of phosphorus-containing compounds, less than 0.2% by weight (or 0.2 g/100 g), more particularly less than 0.1% by weight of free fatty acids, and less than 3 ppm (or 3 mg/kg), more particularly less than 0.02 ppm (or 0.02 mg/kg) of Na, K, Mg, Ca and/or Fe ions are contained therein.

The invention further provides refined and ameliorated lipid phases obtainable according to any of the methods described herein, having a content of water-binding organic lipophilic turbidity-inducing agents of less than 10% with respect to the starting amount, wherein the lipid phase contains less than 5 ppm of phosphorus-containing compounds, less than 0.1% by weight of free fatty acids, and less than 3 ppm of Na, K, Mg, Ca and/or Fe ions.

The invention further provides refined and ameliorated lipid phases obtainable according to any of the methods described herein, having a content of water-binding organic lipophilic turbidity-inducing agents of less than 10% with respect to the starting amount, wherein the lipid phase contains less than 5 ppm (or 5 mg/kg) of phosphorus-containing compounds, less than 0.1% by weight (g/100 g) of free fatty acids, and less than 3 ppm (or 3 mg/kg) of Na, K, Mg, Ca and/or Fe ions.

Furthermore, the removal method according to the invention is also usable in an especially advantageous manner because the solid adsorption agents can be made reusable in a cost-effective manner. Furthermore, the removal according to the invention is oriented to obtaining the separated organic turbidity-inducing agents.

Definitions

Lipid Phase

Here, all organic carbon compounds of biological origin are taken together as lipid phase. The term, as used here, encompasses substance mixtures of biological origin, which mixtures can thus be obtained from plants, algae, animals and/or microorganisms and which mixtures have a water content of <10% and a content of lipophilic substances comprising monoacylglycerides, diacylglycerides and/or triacylglycerides of altogether >70% by weight or >75% by weight or >80% by weight or >85% by weight or >90% by weight or >95% by weight. For instance, the lipid phases can, for example, be extracts of oil-containing plants and microorganisms, such as kernels of rapeseed, sunflower, soy, gold-of-pleasure, jatropha, palms, ricinus, but also of algae and microalgae and also be animal fats and oils. In this connection, it is unimportant whether the lipid phase is a suspension, emulsion or colloidal liquid.

If the lipid phases are extracts or extraction phases of lipid substances from a removal or extraction that had been carried out earlier, the lipid phase can also consist of organic solvents or hydrocarbon compounds to an extent of >50% by volume.

Preferred lipid phases are plant oils, especially in this case pressed and extraction oils of oil plant seeds. However, preference is also given to animal fats. However, nonpolar aliphatic or cyclic hydrocarbon compounds are also included. These lipid phases are notable for the fact that >95% by weight of the compounds therein are apolar.

In the context of the definition used here, the lipid phases include, inter alia, acai oil, acrocomia oil, almond oil, babassu oil, blackcurrant seed oil, borage seed oil, rapeseed oil, cashew oil, castor oil, coconut oil, coriander oil, corn oil, cotton seed oil, crambe oil, linseed oil, grape seed oil, hazelnut oil, other nut oils, hempseed oil, jatropha oil, jojoba oil, macadamia nut oil, mango seed oil, cuckoo flower oil, mustard oil, hoof oil, olive oil, palm oil, palm kernel oil, palm olein oil, peanut oil, pecan oil, pine nut oil, pistachio oil, poppy seed oil, rice germ oil, safflower oil, camellia oil, sesame oil, shea butter oil, soy oil, sunflower oil, tall oil, tsubaki oil, walnut oil, varieties of "natural" oils with altered fatty acid compositions via genetically modified organisms (GMOs) or traditional breeds, *Neochloris oleoabundans* oil, *Scenedesmus dimorphus* oil, *Euglena gracilis* oil, *Phaeodactylum tricornutum* oil, *Pleurochrysis carterae* oil, *Prymnesium parvum* oil, *Tetraselmis chuii* oil, *Tetraselmis suecica* oil, lsochrysis galbana oil, *Nannochloropsis salina* oil, *Botryococcus braunii* oil, *Dunaliella tertiolecta* oil, nannochloris oil, spirulina oil, chlorophyceae oil, bacilliariophyta oil, a mixture of the preceding oils and animal oils (especially marine animal oils), algae oils, oils from bran recoveries, for example rice bran oil and biodiesel.

Ameliorated Lipid Phase

Ameliorated lipid phase is understood here to mean a lipid phase for which one of the methods according to the invention for adsorbing and separating or complexing and separating hydrated turbidity-inducing agents has been carried out.

Refined Lipid Phase

The lipid phase obtained after an aqueous refining is understood as the refined lipid phase; this means the lipid phase which is obtained after the last method step of one of the methods according to the invention.

Purified Lipid Phase

Purified lipid phase means the lipid phase which is obtained after the last method step of one of the methods according to the invention. "Purified lipid phase" and "refined lipid phase" are used synonymously.

Aqueous Refining or Aqueously Refined Lipid Phase

In the present application, "aqueous refining" refers to the aqueous purification step with a neutral or basic solution for providing the "aqueously refined lipid phase". Therefore, "aqueously refined lipid phase" is synonymous with "lipid phase" which is present after the purification with a neutral or basic solution.

Prepurified Lipid Phase

In the present application, the "prepurified lipid phase" is the lipid phase which is present after the purification with a neutral or basic solution. Therefore, a prepurified lipid phase is also understood to mean an aqueously refined lipid phase.

"Lipid Phase to be Purified"

The lipid phase to be purified is the crude lipid phase before it has been subjected to at least one aqueous refining with a neutral or basic solution.

Turbidity-Inducing Agents

Here, organic compounds which can be defined by the following characteristic features are subsumed under turbidity-inducing agents: a) organic compound naturally occurring in a biogenic lipid phase and having lipophilic properties, characterized by a $K_{OW}$ of >2, the designation $K_{OW}$ referring to the partition coefficient between n-octanol and water, and b) organic compound having a molecular weight of not more than 5000 Da, and c) organic compound causing a hydrodynamic radius of more than 100 nm in a hydrated state and d) organic compound allowing an uptake of water molecules.

The organic turbidity-inducing agents removable according to the invention on the basis of adsorption or complexing have at least two of the above-described features, which can be investigated by methods which are known and can be carried out by a person skilled in the art, such as, for example, a molecular weight determination, a calculation of the $K_{OW}$ partition coefficient, a determination of the hydrodynamic radius by means of a dynamic laser light scattering method (DLS) and the determination of the content of water.

The organic water-binding compounds include organic dye compounds such as carotenes and carotenoids, chlorophylls, and the degradation products thereof, additionally phenols, phytosterols, especially β-sitosterol and campesterol and also stigmasterol, sterols, sinapines, squalenes. Phytoestrogens, such as, for example, isoflavones or lignans. Furthermore, steroids and derivatives thereof such as saponins, additionally glycolipids and glyceroglycolipids and glycerosphingolipids, additionally rhamnolipids, sophorolipids, trehalose lipids, mannosylerythritol lipids. Similarly polysaccharides, such as rhamnogalacturonans and polygalacturonic esters, arabinans (homoglycans), galactans and arabinogalactans, furthermore pectic acids and amidopectins.

Furthermore phospholipids, especially phosphatidylinositol, phosphatides, such as phosphoinositide, additionally carboxylic acids and long-chain or cyclic carbon compounds, such as waxes, wax acids, furthermore fatty alcohols, hydroxy and epoxy fatty acids. Similarly glycosides, lipoproteins, lignins, phytate or phytic acid and glucosinolates. Proteins, including albumins, globulins, oleosins, vitamins, such as, for example, retinol (vitamin A) and derivatives thereof, such as, for example, retinoic acid, riboflavin (vitamin B2), pantothenic acid (vitamin B5), biotin (vitamin B7), folic acid (vitamin B9), cobalamins (vitamin B12), calcitriol (vitamin D) and derivatives thereof, tocopherols (vitamin E) and tocotrienols, phylloquinone (vitamin K) and menaquinone. Additionally also tannins, terpenoids, curcuminoids, xanthones, but also sugar compounds, amino acids, peptides, including polypeptides and also carbohydrates such as glucogen.

Since lipid phases of differing origin can be cleared of turbidity-inducing agents using the method according to the invention, the selection of turbidity-inducing agents is not restricted to the ones mentioned here by name. Preference is given to using one of the methods described herein to remove water-binding organic lipophilic turbidity-inducing agents, such as carotenes, chlorophylls, phenols, sterols, squalenes, waxes, wax acids, wax alcohols, glycolipids, glyceroglycolipids and/or glycerosphingolipids. Additionally aldehydes, ketones, peroxide compounds and carboxylic acids.

Acids and Bases

Here, acids refer to compounds capable of donating protons to a reaction partner, especially water.

Accordingly, the term bases refers to compounds capable of receiving protons, especially in aqueous solutions.

Carboxylic Acids

Carboxylic acids are organic compounds bearing one or more carboxyl groups. A distinction is made between aliphatic, aromatic and heterocyclic carboxylic acids. Aliphatic forms of carboxylic acids, also called alkanoic acids, are fatty acids and are explained further in the following paragraph.

Fatty Acids

In general, fatty acids are aliphatic carbon chains with a carboxyl group. The carbon atoms can be linked by single bonds (saturated fatty acids) or by double bonds (unsaturated fatty acids); said double bonds may be present in a cis or trans configuration. According to the definition here, fatty acids refer to such compounds which have more than 4 consecutive carbon atoms besides the carboxyl group. Examples of linear saturated fatty acids are decanoic acid (capric acid), dodecanoic acid (lauric acid), tetradecanoic acid (myristic acid), hexadecanoic acid (palmitic acid), octadecanoic acid (stearic acid), n-eicosanoic acid (arachidic acid) and n-docosanoic acid (behenic acid).

Separation

A person skilled in the art understands separation to mean the separation of a substance mixture. Depending on the type of separation methods used, which each require an expenditure of energy to achieve a certain degree of separation, what are obtained are substances of differing purity. Separation thus means the removal of substances from a substance mixture. The separation methods, as used here, include a phase separation of liquid substance mixtures, which separation can be achieved by sedimentation and/or centrifugation and/or filtration. In this case, the centrifugal separation can be achieved continuously by means of a separator or decanter technology or batchwise by means of a centrifuge. A filtration-based separation can be achieved by the lipid phase already containing the compounds/aggregates to be removed being allowed through or being transported through a filter having a particular screening size, with the compounds/aggregates, which are larger than the minimum screening size preferably to an extent of 100%, being retained and not passing the filter. Other techniques for separating phases that are known to a person skilled in the art can likewise be used.

Extraction

For a person skilled in the art, the term "extraction" is a name for a removal method in terms of removal of particular constituents from solid or liquid substance mixtures by means of suitable solvents (extraction agents). A distinction is made between solid/liquid extraction and liquid/liquid extraction. In this case, the phases are mixed together in a liquid/liquid extraction and the extraction is followed by a phase separation in which the phases are separated from one another. The term extraction, as used here, means the removal of turbidity-inducing agents from their substance-based (organic) matrix by means of an extraction agent, which can consist of an adsorption agent or a complexing agent for the turbidity-inducing agents to be removed. In other words, what is achieved is a possibility to extract the hydrated turbidity-inducing agents by means of an adsorptive attachment to an adsorbent, as described herein, or by means of an ionic or covalent linkage to a cation described herein, which is defined herein as complexing.

Adsorption

For a person skilled in the art, adsorption is the attachment of substances on the surface of solids. Such attachments are mainly caused by physicochemical interactions; in addition however, chemical linkages are also possible.

Adsorption Agent

The term "adsorption agent", which is used synonymously with the terms "adsorbent", is understood here to mean a substance-based linkage composed of inorganic and/or organic constituents, having a fixed state of aggregation. The adsorption agent has surface properties which allow an adsorption of elements or compounds. In particular, the turbidity-inducing agents described herein can be attached and/or embedded and thus bound by means of what are understood here to mean adsorption agents.

Aggregation

In general, aggregation means the accumulation or the gathering of atoms or molecules. Within the scope of separation methods, a person skilled in the art understands this to mean, inter alia, the accumulation of atoms or molecules in liquid up to the point at which the aggregate is no longer soluble and is precipitated.

Complexing

The term is understood here to mean a physical and/or physicochemical and/or chemical linkage between two or more elements and/or compounds. In this connection, the elements can be present in their elemental or ionized form; compounds can be present as molecules having 2 or more atoms, and it is unimportant whether they are organic or inorganic compounds. Furthermore, the term "complexing" encompasses a physical and/or physicochemical and/or chemical linkage with or between complexes, which linkage has already been formed with a compound owing to a complexing with a complexing agent as described herein, and, as a result, aggregates can also be formed.

Complexing Agent

The term "complexing agent", as used herein, is understood to mean elements which are ionizable in water and/or release ions, making possible a complexing with turbidity-inducing agents, as described herein.

Cellulose and Cellulose Derivatives

Cellulose is a polysaccharide of the formal empirical composition ($C_6H_{10}O_5$), more precisely: an isotactic β-1,4-polyacetal of cellobiose (4-O-β-D-glucopyranosyl-D-glucose). Cellobiose in turn consists of two molecules of glucose. Approx. 500 to 5000 glucose units are linked to one another in an aliphatic and unbranched manner, causing average molar masses of from 50 000 to 500 000. In cellulose derivatives, the hydrogen atoms on the free hydroxy groups of the glucose units can be replaced by —$CH_3$, —$C_2H_5$, —$C_3H_7$, —$C_4H_9$, —$C_5H_{11}$, —$CH_2CH_2OH$, —$CH_2CH_2CH_2OH$, —$CH_2CH_2CH_2CH_2OH$, —$CH_2CH_2CH_2CH_2CH_2OH$, —$CH_2CH(OH)CH_3$, —$CH_2CH(OH)CH_2OH$, —$CH_2CO_2H$, —$CH_2CH_2SO_3H$, —$CH_2CH_2SO_3^-$, —C(=O)$CH_3$, —C(=O)$CH_2CH_3$, —C(=O)$CH_2CH_2CH_3$, —C(=O)$CH_2CH_2CH_2CH_3$, —C(=O)CH(OH)$CH_3$, hydrophobic long-chain branched and nonbranched alkyl residues, hydrophobic long-chain branched and nonbranched alkylaryl residues or arylalkyl residues, cationic residues, —$NO_2$, —$SO_3H$, —$SO_3^-$.

Examples of cellulose derivatives are hydroxyethyl cellulose (HEC), hydroxypropyl cellulose (HPC), ethyl hydroxyethyl cellulose (EHEC), carboxymethyl hydroxyethyl cellulose (CMHEC), hydroxypropyl hydroxyethyl cellulose (HPHEC), methyl cellulose (MC), methyl hydroxypropyl cellulose (MHPC), methyl hydroxypropyl hydroxyethyl cellulose (MHPHEC), methyl hydroxyethyl cellulose (MHEC), carboxymethyl cellulose (CMC), hydrophobically modified hydroxyethyl cellulose (hmHEC), hydrophobically modified hydroxypropyl cellulose (hmHPC), hydrophobically modified ethyl hydroxyethyl cellulose (hmEHEC), hydrophobically modified carboxymethyl hydroxyethyl cellulose (hmCMHEC), hydrophobically modified hydroxypropyl hydroxyethyl cellulose (hmHPHEC), hydrophobically modified methyl cellulose (hmMC), hydrophobically modified methyl hydroxypropyl cellulose (hmMHPC), hydrophobically modified methyl hydroxyethyl cellulose (hmMHEC), hydrophobically modified carboxymethyl methyl cellulose (hmCMMC), sulfoethyl cellulose (SEC), hydroxyethyl sulfoethyl cellulose (HESEC), hydroxypropyl sulfoethyl cellulose (HPSEC), methyl hydroxyethyl sulfoethyl cellulose (MHESEC), methyl hydroxypropyl sulfoethyl cellulose (MHPSEC), hydroxyethyl hydroxypropyl sulfoethyl cellulose (HEHPSEC), carboxymethyl sulfoethyl cellulose (CMSEC), hydrophobically modified sulfoethyl cellulose (hmSEC), hydrophobically modified hydroxyethyl sulfoethyl cellulose (hmHESEC), hydrophobically modified hydroxypropyl sulfoethyl cellulose (hmHPSEC), and hydrophobically modified hydroxyethyl hydroxypropyl sulfoethyl cellulose (hmHEHPSEC).

Plant Pigments Dyes

The term "dyes" subsumes organic compounds which occur side-by-side in oils and fats of biogenic origin, typically in different quantities and compositions.

Here, all chromophoric compounds which occur in lipid phases are subsumed under the term "plant dyes". The dye which is most dominant and occurs by far in the greatest quantity in plant oils is formed by the group of the chlorophylls and their degradation products, such as pheophytins. In addition, however, there are also compounds which are subsumed under the group of the carotenes or carotenoids. In addition, however, there are also other compound classes, such as those of the flavonoids, curcumins, anthocyanins, betaines, xanthophylls, which also include carotenes and lutein, indigo, kaempferol and xanthophylls, such as neoxanthin or zeaxanthin. These dyes can be present in different quantity ratios in the lipid phases. Said dyes have a differing solubility in water or an organic solvent. The aqueous refining methods described herein allow the removal of lipophilic compounds in an aqueous nanoemulsion, and, as a result, it is possible to transfer otherwise non-water-soluble compounds to an aqueous phase and to remove them with said phase.

The most common representatives of plant dyes are chlorophylls. In plant oils, chlorophylls are typically found in quantities between 10 ppm (or 10 mg/kg) and 100 ppm (or 100 mg/kg). Representatives having a high content of chlorophylls are, in particular, canola and rapeseed oils.

Chlorophylls

Here, compounds which consist of a derivatized porphyrin ring and are divided according to the organic residues into the subgroups a, b, c1, c2 and d are subsumed under the term "chlorophylls". Furthermore, they differ in the number of double bonds between carbon atoms 17 and 18.

Chlorophylls are the dyes which occur most frequently in plant oils. Owing to their hydrophobicity or the lipophilicity, they partition very well into lipid phases, especially triglyceride mixtures. They cause a green color of the lipid phase; furthermore, they cause a relatively low oxidation stability of the lipid phase owing to the linkage/introduction of magnesium or copper ions. Therefore, their removal from such a lipid phase is desired, especially when an edible oil is concerned in this case. The absolute amounts found in lipid phases and especially in plant oils vary considerably and extend from 0.001 ppm (or 0.001 mg/kg) to 1000 ppm (or 1000 mg/kg).

Nondegraded chlorophylls are practically insoluble in water. Therefore, aqueous refining methods are also not suitable for extracting these dyes from a lipid phase. Since the determination of the absolute concentrations can be obtained by a high level of analytical effort, it is more practical to ascertain the content of dyes by a spectrometric determination of the color contents of a lipid phase. Established for the determination of various color spectra in an oil is the Lovibond method, in which levels of intensity of red, yellow and green shades are determined and compared with a reference value. It is therefore possible to assess an assessment of the oil color in general, and a change in the coloring.

Areas of Application

The inventive raffinate amelioration method is usable for all lipid phases, as described herein, which are of biogenic origin and contain water-binding, highly lipophilic compounds which turn out to be turbidity-inducing agents in the context of a refining process or afterwards by means of an introduction of water. Since the turbidity-inducing agents, for the amelioration method according to the invention, must firstly be removed or decomplexed from an organic matrix, the inventive use of the amelioration method is restricted to a refining step after an aqueous refining, as described herein. This concerns the purification/refining of oils, specifically of plant oils, but also animal fats, in which the removal of turbidity-inducing agents is desired. This especially concerns edible oils, scented oils, massage oils, skin oils right up to lamp oils. Furthermore, it is possible to ameliorate other organic mixtures, such as plant extracts, or the distillation products thereof. In addition natural or synthetically produced mixtures composed of hydrocarbon compounds or esterified fatty acids. Furthermore lipid phases suitable for technical applications, such as oil-based fuels or lubricants or hydraulic oils.

Furthermore, the invention provides a method for adsorbing and extracting or complexing and extracting carotenes, chlorophylls, phenols, sterols, squalenes, glycolipids, glyceroglycolipids and/or glycerosphingolipids and/or waxes or wax acids of aqueously refined lipid phases, characterized by a) providing a lipid phase containing carotenes, chlorophylls, phenols, sterols, squalenes, glycolipids, glyceroglycolipids and/or glycerosphingolipids and/or waxes or carboxylic acids, wherein the lipid phase was subjected to at least one aqueous refining with a neutral or basic solution, b) contacting an adsorption agent and/or a complexing agent with the lipid phase from step a), c) separating the adsorbed or complexed carotenes, chlorophylls, phenols, sterols, squalenes, glycolipids, glyceroglycolipids, glycerosphingolipids and/or waxes or carboxylic acids from step b) by means of a phase separation, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

Furthermore, the invention provides a method for adsorbing and extracting or complexing and extracting water-binding organic lipophilic turbidity-inducing agents of aqueously refined lipid phases, characterized by a) providing a lipid phase containing water-binding organic lipophilic turbidity-inducing agents, wherein the lipid phase was subjected to at least one aqueous refining with an aqueous solution containing at least one guanidine-group- or amidine-group-bearing compound having a $K_{OW}$ of <6.3, b) contacting an adsorption agent and/or a complexing agent with the lipid phase from step a), c) separating the adsorbed or complexed water-binding organic lipophilic turbidity-inducing agents from step b) by means of a phase separation, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

The invention provides a method for adsorbing and extracting water-binding organic lipophilic turbidity-inducing agents of aqueously refined lipid phases, characterized by a) providing a lipid phase containing water-binding organic lipophilic turbidity-inducing agents, wherein the lipid phase was subjected to at least one aqueous refining with a neutral or basic solution, b) contacting cellulose or a cellulose derivative with the lipid phase from step a), c) separating the adsorbed organic lipophilic turbidity-inducing agents from step b) by means of a phase separation.

The invention provides a method for adsorbing and extracting water-binding organic lipophilic turbidity-inducing agents of aqueously refined lipid phases, characterized by a) providing a lipid phase containing water-binding organic lipophilic turbidity-inducing agents, wherein the lipid phase was subjected to at least one aqueous refining with a neutral or basic solution, b) contacting an adsorption agent with the lipid phase from step a), c) separating the adsorbed organic lipophilic turbidity-inducing agents from step b) by means of a phase separation, wherein the adsorption agent is cellulose, a cellulose derivative or an inorganic aluminum oxide silicate having an aluminum fraction of >0.1 mol %.

Furthermore, the invention provides a method for adsorbing and extracting or complexing and extracting carotenes, chlorophylls, phenols, sterols, squalenes, glycolipids, glyceroglycolipids and/or glycerosphingolipids and/or waxes or carboxylic acids of aqueously refined lipid phases, characterized by a) providing a lipid phase containing carotenes, chlorophylls, phenols, sterols, squalenes, glycolipids, glyceroglycolipids and/or glycerosphingolipids and/or waxes or carboxylic acids, wherein the lipid phase was subjected to at least one aqueous refining with an aqueous solution containing at least one guanidine-group- or amidine-group-bearing compound having a $K_{OW}$ of <6.3, b) contacting an adsorption agent and/or a complexing agent with the lipid phase from step a), c) separating the adsorbed or complexed carotenes, chlorophylls, phenols, sterols, squalenes, glycolipids, glyceroglycolipids and/or glycerosphingolipids and/or waxes or carboxylic acids from step b) by means of a phase separation, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

The invention provides a method for adsorbing and extracting carotenes, chlorophylls, phenols, sterols, squalenes, glycolipids, glyceroglycolipids and/or glycerosphingolipids and/or waxes or carboxylic acids of aqueously refined lipid phases, characterized by a) providing a lipid phase containing carotenes, chlorophylls, phenols, sterols, squalenes, glycolipids, glyceroglycolipids, glycerosphingolipids and/or waxes or carboxylic acids, wherein the lipid phase was subjected to at least one aqueous refining with a neutral or basic solution, b) contacting cellulose or a cellulose derivative with the lipid phase from step a), c) separating the adsorbed carotenes, chlorophylls, phenols, sterols, squalenes, glycolipids, glyceroglycolipids and/or glycerosphingolipids and/or waxes or carboxylic acids from step b) by means of a phase separation.

The invention provides a method for adsorbing and extracting carotenes, chlorophylls, phenols, sterols, squalenes, glycolipids, glyceroglycolipids and/or glycerosphingolipids and/or waxes or carboxylic acids of aqueously refined lipid phases, characterized by a) providing a lipid phase containing carotenes, chlorophylls, phenols, sterols, squalenes, glycolipids, glyceroglycolipids, glycerosphingolipids and/or waxes or carboxylic acids, wherein the lipid phase was subjected to at least one aqueous refining with a neutral or basic solution, b) contacting an adsorption agent with the lipid phase from step a), c) separating the adsorbed carotenes, chlorophylls, phenols, sterols, squalenes, glycolipids, glyceroglycolipids and/or glycerosphingolipids and/or waxes or carboxylic acids from step b) by means of a phase separation, wherein the adsorption agent is cellulose, a cellulose derivative or an inorganic aluminum oxide silicate having an aluminum fraction of >0.1 mol %.

The invention provides a method for adsorbing and extracting carotenes, chlorophylls, phenols, sterols, squalenes, glycolipids, glyceroglycolipids and/or glycerosphingolipids and/or waxes or carboxylic acids of aqueously refined lipid phases, characterized by a) providing a lipid phase containing carotenes, chlorophylls, phenols, sterols, squalenes, glycolipids, glyceroglycolipids, glycerosphingolipids and/or waxes or carboxylic acids, wherein the lipid phase was subjected to at least one aqueous refining with an aqueous solution containing at least one guanidine-group- or amidine-group-bearing compound having a $K_{OW}$ of <6.3, b) contacting an adsorption agent with the lipid phase from step a), c) separating the adsorbed carotenes, chlorophylls, phenols, sterols, squalenes, glycolipids, glyceroglycolipids and/or glycerosphingolipids and/or waxes or carboxylic acids from step b) by means of a phase separation, wherein the adsorption agent is cellulose, a cellulose derivative or an inorganic aluminum oxide silicate having an aluminum fraction of >0.1 mol %.

Furthermore, the invention provides a method for complexing and extracting water-binding organic lipophilic turbidity-inducing agents of aqueously refined lipid phases, characterized by a) providing a lipid phase containing water-binding organic lipophilic turbidity-inducing agents, wherein the lipid phase was subjected to at least one aqueous refining with an aqueous solution containing at least one guanidine-group- or amidine-group-bearing compound having a $K_{OW}$ of <6.3, b) contacting a complexing agent with the lipid phase from step a), c) separating the complexed water-binding organic lipophilic turbidity-inducing agents from step b) by means of a phase separation, wherein the complexing agent comprises aluminum ions or iron ions which are present in an aqueous solution.

Furthermore, the invention provides a method for complexing and extracting carotenes, chlorophylls, phenols, sterols, squalenes, glycolipids, glyceroglycolipids and glycerosphingolipids and/or waxes or carboxylic acids of aqueously refined lipid phases, characterized by a) providing a lipid phase containing carotenes, chlorophylls, phenols, sterols, squalenes, glycolipids, glyceroglycolipids and/or glycerosphingolipids and/or waxes or carboxylic acids, wherein the lipid phase was subjected to at least one aqueous refining with an aqueous solution containing at least one guanidine-group- or amidine-group-bearing compound having a $K_{OW}$ of <6.3, b) contacting a complexing agent with the lipid phase from step a), c) separating the complexed carotenes, chlorophylls, phenols, sterols, squalenes, glycolipids, glyceroglycolipids, glycerosphingolipids and/or waxes or carboxylic acids from step b) by means of a phase separation, wherein the complexing agent comprises aluminum ions or iron ions which are present in an aqueous solution.

A further embodiment according to the invention is a method for removing water-binding organic lipophilic turbidity-inducing agents from an aqueously refined lipid phase, characterized by a) providing a lipid phase containing water-binding organic lipophilic turbidity-inducing agents, wherein the lipid phase was subjected to at least one aqueous refining with a neutral or basic solution, b) admixing the lipid phase from step a) with an adsorption agent and/or a complexing agent, c) phase-separating and removing the adsorbed or complexed water-binding organic lipophilic turbidity-inducing agents, the adsorption agent being cellulose, a cellulose derivative or an inorganic aluminum oxide silicate having an aluminum fraction of >0.1 mol % and wherein the complexing agent comprises aluminum ions or iron ions which are present in an aqueous solution.

A further embodiment according to the invention is a method for removing carotenes, chlorophylls, phenols, sterols, squalenes, glycolipids, glyceroglycolipids, glycerosphingolipids and/or waxes or carboxylic acids from an aqueously refined lipid phase, characterized by a) providing a lipid phase containing carotenes, chlorophylls, phenols, sterols, squalenes, glycolipids, glyceroglycolipids, glycerosphingolipids and/or waxes or carboxylic acids, wherein the lipid phase was subjected to at least one aqueous refining with a neutral or basic solution, b) admixing the lipid phase from step a) with an adsorption agent and/or a complexing agent, c) phase-separating and removing the adsorbed or complexed carotenes, chlorophylls, phenols, sterols, squalenes, glycolipids, glyceroglycolipids, glycerosphingolipids and/or waxes or carboxylic acids, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

A further embodiment according to the invention is a method for removing water-binding organic lipophilic turbidity-inducing agents from an aqueously refined lipid phase, characterized by a) providing a lipid phase containing water-binding organic lipophilic turbidity-inducing agents, wherein the lipid phase was subjected to at least one aqueous refining with an aqueous solution containing at least one guanidine-group- or amidine-group-bearing compound having a $K_{OW}$ of <6.3, b) admixing the lipid phase from step a) with an adsorption agent and/or a complexing agent, c) phase-separating and removing the adsorbed or complexed water-binding organic lipophilic turbidity-inducing agents, wherein the adsorption agent is cellulose, a cellulose derivative or an inorganic aluminum oxide silicate having an aluminum fraction of >0.1 mol % and the complexing agent comprises aluminum ions or iron ions which are present in an aqueous solution.

A further embodiment according to the invention is a method for removing carotenes, chlorophylls, phenols, sterols, squalenes, glycolipids, glyceroglycolipids, glycerosphingolipids and/or waxes or carboxylic acids from an aqueously refined lipid phase, characterized by a) providing a lipid phase containing carotenes, chlorophylls, phenols, sterols, squalenes, glycolipids, glyceroglycolipids, glycerosphingolipids and/or waxes or carboxylic acids, the lipid phase having been subjected to at least one aqueous refining with an aqueous solution containing at least one guanidine-group- or amidine-group-bearing compound having a $K_{OW}$ of <6.3, b) admixing the lipid phase from step a) with an adsorption agent, c) phase-separating and removing the adsorbed carotenes, chlorophylls, phenols, sterols, squalenes, glycolipids, glyceroglycolipids, glycerosphingolipids and/or waxes or carboxylic acids, wherein the adsorption agent is cellulose, a cellulose derivative or an inorganic aluminum oxide silicate having an aluminum fraction of >0.1 mol %.

A further embodiment according to the invention is a method for removing water-binding organic lipophilic turbidity-inducing agents from an aqueously refined lipid phase, characterized by a) providing a lipid phase containing water-binding organic lipophilic turbidity-inducing agents, wherein the lipid phase was subjected to at least one aqueous refining with an aqueous solution containing at least one guanidine-group- or amidine-group-bearing compound having a $K_{OW}$ of <6.3, b) admixing the lipid phase from step a) with an adsorption agent, c) phase-separating and removing the adsorbed water-binding organic lipophilic turbidity-inducing agents, wherein the adsorption agent is cellulose, a cellulose derivative or an inorganic aluminum oxide silicate having an aluminum fraction of >0.1 mol %.

A further embodiment according to the invention is a method for removing water-binding organic lipophilic turbidity-inducing agents from an aqueously refined lipid phase, characterized by a) providing a lipid phase containing water-binding organic lipophilic turbidity-inducing agents, wherein the lipid phase was subjected to at least one aqueous refining with an aqueous solution containing at least one guanidine-group- or amidine-group-bearing compound having a $K_{OW}$ of <6.3, b) admixing the lipid phase from step a) with a complexing agent, c) phase-separating and removing the complexed water-binding organic lipophilic turbidity-inducing agents, wherein the complexing agent comprises aluminum ions or iron ions which are present in an aqueous solution.

A further embodiment according to the invention is a method for removing carotenes, chlorophylls, phenols, sterols, squalenes, glycolipids, glyceroglycolipids and/or glycerosphingolipids and/or waxes or carboxylic acids from an aqueously refined lipid phase, characterized by a) providing a lipid phase containing carotenes, chlorophylls, phenols, sterols, squalenes, glycolipids, glyceroglycolipids and/or glycerosphingolipids and/or waxes or carboxylic acids, wherein the lipid phase was subjected to at least one aqueous refining with an aqueous solution containing at least one guanidine-group- or amidine-group-bearing compound having a $K_{OW}$ of <6.3, b) admixing the lipid phase from step a) with a complexing agent, c) phase-separating and removing the complexed carotenes, chlorophylls, phenols, sterols, squalenes, glycolipids, glyceroglycolipids and/or glycerosphingolipids and/or waxes or carboxylic acids, wherein the complexing agent comprises aluminum ions or iron ions which are present in an aqueous solution.

DESCRIPTION OF THE FIGURES

FIG. 1: shows Table 1.3 in relation to Example 1.
FIG. 2: shows Table 2.2 in relation to Example 2.
FIG. 3: shows Table 5.2 in relation to Example 5.
FIG. 4: shows Table 6.1 in relation to Example 6.
FIG. 5: shows Table 7 in relation to Example 7.

EXAMPLES

Methods of Measurement

The following methods of measurement were used for the purposes of the exemplary embodiments described below:

The content of phosphorus, calcium, magnesium and iron in the lipid phase was determined by means of ICP OES (Optima 7300, PerkinElmer, Germany). Specified values in ppm (or in mg/kg).

The fraction of free fatty acids in the lipid phase was determined by means of a methanolic KOH titration using a Titroline 7000 titrator (SI Analytics, Germany). Specified values in % by weight (g/100 g).

The water content in the lipid phase, which content is also referred to herein as oil moisture, was determined by means of an automatic titration in accordance with the Karl Fischer method (Titroline 7500 KF trace, SI Analytics, Germany); specified values in % by weight.

The determination of a turbidity of a lipid phase was achieved by means of a visual examination, involving a cuvette having a diameter of 3 cm being filled with the oil to be examined and the identifiability of image lines when viewed through the cuvette being assessed by 2 investigators under standardized light conditions. In addition, the brilliance of the sample when viewed in daylight was assessed. In the case of a distortion-free identification of the image lines and optical brilliance, the oil sample was rated as transparent. In the case of distinct distortion of the line contours with impeded identification of the image lines and a view that was no longer clear, the result was the rating slightly turbid. If it was still possible to identify image lines, but no longer possible to differentiate them, and the optical appearance was turbid, the result was a classification of moderately turbid. If no more lines were identifiable and a view through the oil sample was no longer possible, the result was the classification highly turbid. A classification of "milky" was the result in the case of an appearance equal to that of a milk. In comparison to turbidimetry measurements carried out in parallel (see below), it became apparent that oils rated as transparent (turbidity (TR)=1) were within the range <15 FTU; in the case of a slight turbidity (TR=2) of the oils, there were FTU values of from 16 to 50, and in the case of a moderate turbidity (TR=3), there were FTU values between 51 and 200; in the case of a high turbidity (TR=4), FTU values between 201 and 1000 were measured, and in the case of milky emulsions (TR=5), there were FTU values of >1000.

A quantification of the turbidity (turbidimetry) of oil phases was also carried out by means of a scattered light recording, which determines the re-entry of a scattered beam at 90° with a measurement probe immersed in a sample volume of 10 ml (InPro 8200 measurement sensor, M800-1 transmitter, Mettler Toledo, Germany).

The measurement range is from 5 to 4000 FTU. Duplicate determinations are always carried out for each sample. Determinations of droplet or particle sizes were achieved by means of a noninvasive laser light backscattering analysis (DLS) (Zetasizer Nano S, Malvern, UK). To this end, 2 ml of a liquid to be analyzed were filled into a measurement cuvette and inserted into the measurement cell. The analysis on particles or phase-boundary-forming droplets proceeds automatically. A measurement range of from 0.3 nm to 10 μm is covered.

The determination of secondary oxidation products in a lipid phase was achieved by means of a p-anisidine reaction, which was quantified photometrically. To this end, 20 μl of an oil sample were filled into a test cuvette already containing the test reagent and placed immediately thereafter into the measurement cell of an automatic analyzer (FoodLab, Italy). The measurement range is between 0.5 and 100. Each sample was analyzed twice.

All examinations were carried out under normal pressure conditions (101.3 Pa) and at room temperature (25° C.), unless otherwise specified.

Example 1

300 kg of pressed rapeseed oil having the characteristic values specified in Table 1.3 (FIG. 1) were subjected to a multistep refining method. To this end, the rapeseed oil was filled into a reservoir tank (Reservoir Tank 1). Thereafter, the oil in Reservoir Tank 1 is heated to 50° C. and then admixed with 0.1% by weight of citric acid (25% by weight, at room temperature) and homogenized using a rotor-stator homogenizer (Fluco MS 4, Fluid Kotthoff, Germany) at a rotational frequency of 1000 rpm for 30 minutes and. Afterwards, 0.4% by weight of water are added and stirred at 100 rpm for 15 min. Thereafter, phase separation using a separator (OSD 1000, MKR, Germany) at a throughput capacity of 100 L/h and a rotational frequency of 10 000 rpm. The clear oily phase A obtained is transferred to a further reservoir tank (Reservoir Tank 2). 125 ml of the oily phase A were used for chemical analysis.

The thus obtained oily phase A is brought to a process temperature of 40° C. and a 4% by volume of a 10% by weight potassium carbonate solution is added. Thereafter, an intensive mixing is carried out using the aforementioned homogenizer at a rotational frequency of 1000 rpm for 15 minutes. The emulsion obtained is pumped into the separator and a phase separation is carried out with the same parameter settings. The slightly turbid oily phase B obtained is transferred to Reservoir Tank 3. 125 ml of the oily phase B were used for chemical analysis.

The oily phase B is brought to a process temperature of 35° C. and 3% by volume of a 0.5 molar arginine solution are added. Thereafter, an intensive mixing is carried out for 10 min using the aforementioned mixing tool with the same setting. The emulsion obtained is pumped into the separator and the phase separation is effected at a capacity of 200 L/h. The distinctly turbid oily phase C obtained is transferred to Reservoir Tank 4. 125 ml of the oily phase C were used for chemical analysis. (Determination of the characteristic oil numbers in accordance with "Methods of measurement".)

Afterwards, in independent tests with, in each case, 10 kg of the prepurified rapeseed oil using a propeller mixer (200 rpm), the adsorption agents listed in the following table were added in the form of powdered solids to a portion of the aqueously refined oil and stirred at a constant temperature of 30° C. for a period of 20 minutes:

TABLE 1.1

| test No. | adsorption agent | PS (μm) | MW (Da) | amount |
|---|---|---|---|---|
| 1.1 | hydroxyethyl cellulose (H 200000 YP2) | <180 | 400 | 50 g |
| 1.2 | celite (VWR) | n.s. | n.a. | 100 g |
| 1.3 | tiisyl (Grace) | n.s. | n.a. | 100 g |
| 1.4 | kaolin (VWR) | n.s. | n.a. | 80 g |
| 1.5 | Tonsil Optimum 210 FF | n.s. | n.a. | 250 g |
| 1.6 | Tonsil Supreme 118 FF | n.s. | n.a. | 250 g |
| 1.7 | hydroxyethyl cellulose (H 60000 YP2) | <180 | 300 | 25 g |
| 1.8 | hydroxyethyl cellulose (H 60000 YP2) | <180 | 300 | 100 g |
| 1.9 | methyl hydroxypropyl cellulose (90SH-100000) | <150 | 150 | 25 g |
| 1.10 | methyl hydroxypropyl cellulose (90SH-100000) | <150 | 150 | 100 g |
| 1.11 | methyl hydroxyethyl cellulose (MHS 300000 P4) | <120 | 500 | 25 g |
| 1.12 | methyl hydroxyethyl cellulose (MHS 300000 P4) | <120 | 500 | 100 g |

PS: particle size;
MW: molecular weight;
n.s.: not specified

Furthermore, in further tests, the single addition of 100 ml of each of the solutions listed in Table 1.2 below was carried out, which solutions were stirred into, in each case, 10 kg of prepurified oil phase C, as described above:

TABLE 1.2

| test No. | complexing agent |
|---|---|
| 2.1 | aqueous solution of a 1.5 molar aluminum chloride solution |
| 2.2 | 2 molar aluminum sulfate solution |
| 2.3 | 3.5 molar iron(III) chloride solution |
| 2.4 | 3 molar calcium chloride solution |
| 2.5 | 3 molar magnesium sulfate solution |
| 2.6 | 3 molar copper chloride solution |
| 2.7 | 3 normal NaCl solution |
| 2.8 | 3 molar aluminum sulfate solution |
| 2.9 | 0.5 molar aluminum chloride solution |
| 2.10 | 9 wt % polyaluminum chloride solution |

After 60 minutes, a phase separation of the individual oil phases was carried out using a separator (as described above).

As reference (reference test [RT]), 1 kg of the prepurified lipid phase was dried using a vacuum dryer (VC-130SC, Cik, Germany) at a temperature of 85° C. over a period of 120 min and under a pressure of 0.01 Pa.

Following the adsorptive treatment in accordance with Tests 1.1 to 1.12 and the complexing treatment in accordance with Tests 2.1 to 2.10, 1 liter of the treated oil phases was taken off in each case and provided with 50 ml of demineralized water and stirred using a stirring mixer at a speed of 500 rpm for 10 minutes at a temperature of 25° C. This is followed by a centrifugal removal at 3000 g for 10 minutes. After that, a repeat determination of the water content of said oil phases and an assessment of the turbidity (see "Methods of measurement" for the procedure) were carried out. From the treated oil phases, 10 ml samples were further taken in each case, one of said samples being frozen immediately (D0) and the second being stored for 120 days (D120) in an open vessel exposed to daylight. This was followed by determination of the anisidine value (procedure as per the description under "Methods of measurement"), the D0 samples being thawed for this purpose and analyzed in a sample run with the stored samples (D120).

Results (numerical results are summarized in Table 1.3 (FIG. 1)): With the cellulose ethers used according to the invention (Test 1.1) and with the kaolin used according to the invention (Test 1.4), it was possible to achieve a very good clarification of the aqueously refined oils. The other adsorption agents used in Tests 1.2, 1.3, 1.5 and 1.6 did not allow a satisfactory clarification. Further investigations in relation to the inventive cellulose ethers in accordance with Tests 1.7 to 1.12 confirm the removal of turbidity-inducing agents from the purified oil phase when using various molar ratios.

In the aqueous refining step according to the invention, the dissolved aluminum compounds in Tests 2.1, 2.2, 2.8 to 2.10 likewise showed a complete clarification of the prepurified oil phases, and to a lesser extent for solutions containing dissolved iron(III) ions (Test 2.3), whereas other metal ions (Tests 2.4 to 2.7), which were present in dissociated form in an aqueous solution, did not allow this.

After renewed agitation with water and subsequent centrifugal phase separation, it became apparent that, after a treatment according to the invention with an adsorption or complexing agent, there is only a very low renewed introduction of water into the refined lipid phases, and, as a result, said oil phases also remain clear. This was not the case for the substances that were alternatively used. A renewed introduction of water was also possible when the prepurified oil had been subjected only to a vacuum drying process. In the crude oil, there were secondary oxidation products which could be removed to a very large extent by means of the aqueous refining method. Owing to the treatment of the prepurified lipid phase with the adsorption or complexing agents according to the invention, the content of secondary oxidation products was reduced to a range that is no longer measurable (depending on the method). By means of the comparative substances, the secondary oxidation products were only slightly lowered or even elevated. As a result of the exposure of atmospheric oxygen and an irradiation of light, secondary oxidation products were formed in all the oils. The differences between the oil phases treated with the compounds according to the invention and those which had not been treated or had been treated with comparative compounds were even much greater after 90 days than was the case after the initial treatment.

Example 2

A fermentational conversion of organic waste materials with subsequent transesterification of the lipid substance mixture obtained yielded 50 liters of organic phase (approx. 98% fatty acid methyl esters). The aqueous refining was carried out under fundamentally the same mixing and separation conditions as mentioned in Example 1. In the first step, 2% by volume of a 15% by weight metasilicate solution are used, the reaction temperature differing and being at 50° C. The oily phase A removed was moderately turbid. The 2nd refining step was carried out with a 2% by volume 0.6 molar arginine solution. The reaction temperature was 28° C. in this case. The oil phase B obtained was highly turbid. Samples taken in each case for analysis. (Determination of the characteristic oil numbers in accordance with "Methods of measurement".)

30 kg of the thus prepurified biodiesel were further refined using the adsorption agents listed below. This involved adding the adsorption agents listed below in separate tests of 1.5 kg each. One sample was dried in a vacuum drying process, as mentioned in Example 1.

TABLE 2.1

| t.-No. | adsorption agent | amount |
|---|---|---|
| 1.1 | hydroxyethyl cellulose (H 200000 YP2) | 1.0 g |
| 1.2 | hydroxyethyl cellulose (H 60000 YP2) | 1.0 g |
| 1.3 | methyl hydroxyethyl cellulose (MHS 300000 P4) | 1.5 g |
| 1.4 | methyl hydroxypropyl cellulose (90SH-100000) | 1.5 g |
| 1.5 | hypromellose 2910 | 3.0 g |
| 1.6 | methyl hydroxyethyl cellulose (MCE 100TS) | 3.0 g |
| 1.7 | hydroxyethyl cellulose (HX 6000 YG4) | 3.0 g |
| 1.8 | kaolin | 3.0 g |

Furthermore, the addition of aluminum trichloride, which was present in dissolved form in a low-ion water in the concentrations of 0.01, 0.05 and 0.1 molar (Test Nos. 2.1 to 2.3), and with polyaluminum chloride ($Al_2(OH)_{2.1}Cl_{3.9}$×2-3 H2O), which was present in the same concentrations in an aqueous solution (Test Nos. 2.4 to 2.6), was carried out by addition of 10 ml in each case to the solution preparations. The substances were mixed in using a hand mixer over a period of 5 minutes. Afterwards, the samples were left to stand for 30 minutes. Thereafter, centrifugation was carried out using a centrifuge at 3000 rpm over a period of 7 min. The oil phases were decanted in the case of the adsorption agents; in the case of the aqueous extractions, the oil phases were taken off. In the case of one sample of the prepurified oil phase (Test 1.9), a vacuum drying process as specified in Example 1 was carried out. This was followed by, for all samples, an introduction of demineralized water into the obtained oil phases in the same manner as described in Example 1. The analyses of the water content and the turbidity of the organic phases were carried out as described in Example 1 or under "Methods of measurement".

Results: Both the cellulose ethers used as adsorption agents and the aluminum-containing phyllosilicate and the aluminum-ion-containing solutions used for complexing brought about a complete clarification of the lipid phases (Table 2.2 (FIG. 2)), and so all the refined oil phases were ultimately transparent. Accordingly, the residual moisture for all the samples in which adsorption agents had been added was within a range between 0.01 and 0.09% by weight, and in the case of the oils treated with the complexing agents, between 0.01 and 0.14% by weight.

After the renewed introduction of water, there were somewhat higher water reintroduction values for the samples which had been treated with the lowest concentrations of complexing agents than for the samples which had been treated with higher concentrations of the substances. A removal of residual water from the prepurified oil could also be performed by means of a vacuum drying process; however, for this oil phase, a renewed introduction of water to a relevant extent was possible. In the aqueous phase of the separated complexing agents, it was possible to identify aggregated particles, the amount of which did not differ between the selected concentrations.

Example 3

500 kg of pressed jatropha oil were aqueously refined in multiple steps, the process technology substantially corresponding to that of Example 1. The aqueous refining was carried out under fundamentally the same mixing and separation conditions as mentioned in Example 1. In contrast thereto, use was made in the first step of 4% by volume of an 8% by weight sodium borate solution, which was introduced at 25° C. using a propeller stirrer. The oily phase A removed was subtly turbid. The 2nd refining step was carried out by means of an addition of 3% by volume of a 5% by weight sodium hydrogen carbonate solution at 50° C. Here too, the introduction was carried out using a propeller stirrer over 30 minutes. The oil B obtained was slightly turbid. The 3rd aqueous refining step was carried out using 2% by volume of a 12% by weight orthometasilicate solution. The oil phase C obtained was moderately turbid. In the 4th refining step, 2% by volume of a 0.3 molar arginine solution are, as described in Example 1, introduced by means of an intensive mixing process. The reaction temperature was 32° C. in this case. The prepurified oil phase D obtained was highly turbid. Samples taken in each case for analysis. Also taken: a reference sample (TR) for which a vacuum drying process was carried out as described in Example 1. For the dried oil, a test in relation to the re-introducability of water was carried out as per Example 1. (Determination of the characteristic oil numbers in accordance with "Methods of measurement".)

The oil samples exhibited the analysis results in Table 3.1 below.

TABLE 3.1

| | crude oil | oil-phase A | oil-phase B | oil-phase C | oil-phase D |
|---|---|---|---|---|---|
| phosphorous content [ppm] | 252 | 87 | 18 | 6 | 0.8 |
| magnesium [ppm] | 56 | 39 | 1.2 | 0.5 | 0.01 |
| free fatty acids [wt %] | 1.4 | 1.2 | 0.7 | 0.15 | 0.04 |

TABLE 3.1-continued

| | crude oil | oil-phase A | oil-phase B | oil-phase C | oil-phase D |
|---|---|---|---|---|---|
| water content [wt %] | 1.2 | 1.5 | 2.4 | 3.2 | 4.6 |
| oil turbidity | 1 | 1 | 1-2 | 3 | 3 |

rep. = repeated introduction of water; oil turbidity: 1 = transparent, 2 = slightly turbid, 3 = moderately turbid, 4 = highly turbid, 5 = milky; n.d. = not carried out.

The following methyl celluloses were investigated: T 1. hydroxyethyl cellulose (H 200000 YP2), T 2. methyl hydroxypropyl cellulose (90SH-100000), T 3. hydroxyethyl cellulose (H 60000 YP2) with different metered additions (weight ratio of cellulose ether/oil (m/m)) of cellulose:lipid phase: a) 1:99, b) 1:499 and c) 1:999. Additionally, in Test 4, kaolin powder was mixed into the purified oil in a quantity ratio (adsorption agent/oil (m/m)) of a) 1:499 and b) 1:999. Moreover, various volume ratios of an aluminum trichloride (Test 5) and a polyaluminium chloride (Test 6) solution, having a 1.5 molar concentration in each case, were investigated. This involved carrying out the metered addition in the ratio of a) 1:99, b) 1:999 and c) 1:9999. The mixing of the oil phase with the cellulose preparations and the kaolin was carried out using a propeller stirrer; the introduction of the aqueous solutions was carried out using an Ultrathurrax at 9000 rpm.

The determination of oil moisture and of the oil turbidity (see "Methods of measurement") was carried out after the individual refining steps and after the refining processes according to the invention and after a renewed introduction of water and subsequent centrifugal removal of the aqueous phase, as described in Example 1.

TABLE 3.2

| | water content (wt %) | turbidity | rep. water content (wt %) | rep. turbidity |
|---|---|---|---|---|
| V 1 a) | 0.01 | 1 | 0.03 | 1 |
| V 1 b) | 0.02 | 1 | 0.06 | 1 |
| V 1 c) | 0.09 | 1 | 0.14 | 1 |
| V 2 a) | 0.01 | 1 | 0.09 | 1 |
| V 2 b) | 0.02 | 1 | 0.06 | 1 |
| V 2 c) | 0.12 | 1 | 0.16 | 1 |
| V 3 a) | 0.05 | 1 | 0.09 | 1 |
| V 3 b) | 0.08 | 1 | 0.12 | 1 |
| V 3 c) | 0.12 | 1 | 0.15 | 1 |
| V 4 a) | 0.03 | 1 | 0.06 | 1 |
| V 4 b) | 0.10 | 1 | 0.13 | 1 |
| V 5 a) | 0.01 | 1 | 0.02 | 1 |
| V 5 b) | 0.03 | 1 | 0.04 | 1 |
| V 5 c) | 0.07 | 1 | 0.12 | 1 |
| V 6 a) | 0.02 | 1 | 0.02 | 1 |
| V 6 b) | 0.03 | 1 | 0.04 | 1 |
| V 6 c) | 0.04 | 1 | 0.07 | 1 |
| VR | 0.01 | 1 | 0.95 | 1-2 |

oil turbidity: 1 = transparent, 2 = slightly turbid, 3 = moderately turbid, 4 = highly turbid, 5 = milky Results:

The cellulose preparations investigated exhibited a removal of the hydrated turbidity-inducing agents for the turbid oil phase obtained as a result of the aqueous refining, at all the selected volume ratios, and so the achieved water contents of the refined oils were all ≤0.12% by weight. Accordingly, the thus treated oil phases were all transparent. After a repeated introduction of water with subsequent renewed centrifugal phase separation, there was a slight rise in the water content (max. 0.16% by weight) for the oils which had been treated with the lowest amount of cellulose ethers. In the case of the complexing method according to the invention with dissolved aluminum ions, there was also a complete reduction in the turbidity with a similarly good reduction in the oil moisture for all the quantity ratios investigated. Even after a renewed introduction of water, the oil moisture was <0.13% by weight for all the concentrations; accordingly, the oil phases were transparent. A similar result was shown for kaolin. By means of a vacuum drying process, it was likewise possible to reduce the moisture in oil; in the case of this oil, a relevant introduction of water was possible.

Example 4

For the investigations, the following cold-pressed oils were used: of rapeseed (RO), sunflower seeds (SFO) and grape seeds (GSO), having the characteristic numbers: for RO: phosphorus content 4.2 ppm (or 4.2 mg/kg), calcium 25 ppm (or 25 mg/kg), iron 2.1 ppm (or 2.1 mg/kg), free fatty acids 1.0% by weight, and for SFO: phosphorus content 7.2 ppm (or 7.2 mg/kg), calcium 28 ppm (or 28 mg/kg), iron 2.3 ppm (or 2.3 mg/kg), free fatty acids 1.2% by weight, and for GSO: phosphorus content 3.8 ppm (or 3.8 mg/kg), calcium 12 ppm (or 12 mg/kg), iron 1.1 ppm (or 1.1 mg/kg), free fatty acids 0.8% by weight. All the crude oils were clear. 60 ml of a 0.5 molar arginine solution were added to 2000 ml of each of the oils. The mixing is carried out using an Ultrathurrax T18 at 24 000 rpm for 5 minutes. Thereafter, centrifugation of the water-in-oil emulsion in a bucket centrifuge at 5000 rpm for 10 minutes.

The prepurified oil phases obtained have the following characteristic numbers for RO: phosphorus content 1.2 ppm (or 1.2 mg/kg), calcium 0.9 ppm (or 0.9 mg/kg), iron 0.08 ppm (or 0.08 mg/kg), free fatty acids 0.2% by weight, for SFO: phosphorus content 0.8 ppm (or 0.8 mg/kg), calcium 0.2 ppm (or 0.2 mg/kg), iron 0.05 ppm (or 0.05 mg/kg), free fatty acids 0.13% by weight, and for GSO: phosphorus content 0.5 ppm (or 0.5 mg/kg), calcium 0.02 ppm (or 0.02 mg/kg), iron <0.002 ppm (or <0.002 mg/kg), free fatty acids 0.011% by weight. All the oils obtained are moderately to distinctly turbid. (Determination of the characteristic oil numbers in accordance with "Methods of measurement".).

The hydroxyethyl cellulose (H 200000 YP2) (T 1) and methyl hydroxypropyl cellulose (90SH-100000) (T 2) are added to 200 ml of each of the prepurified oils in a weight ratio of the adsorption agent to the oil of 1:499. Additionally, kaolin powder (T 3) is added in a weight ratio of the adsorption agent to the oil of 1:199. Moreover, a 0.5 molar solution of aluminum dichloride (T 4), aluminum sulfate (T 5) and polyaluminium hydroxide chloride sulfate (T 6) is added in a weight ratio of the complexing agent solution to the oil of 1:99. The adsorption and the complexing agents are continuously mixed using a propeller stirrer at a rotational frequency of 500 rpm after initially complete addition. After a) 7 minutes, b) after 15 minutes, c) after 30 minutes and d) after 60 minutes, 10 ml of the agitated oil phases are taken off in each case and separated from the solid or aqueous phase using a centrifuge (3800 rpm/5 minutes). Thereafter, a determination of the optical transparency and of the water content (see "Methods of measurement") is carried out. A comparative sample of the prepurified oil, to which ion-free water was added in a weight ratio of 1:99 with respect to the oil, was likewise agitated using the stirrer; from said sample, at the end point of the investigation period, a sample is taken for vacuum drying as described in Example 1 (T 7), and this is followed by testing for transparency and water content and for the re-introducability of water.

In all the tests, 2 samples (20 ml) were collected in each case at the end time (in the case of Test 7, after drying of the oil) and filled into closable vessels. In each case, one sample was frozen (D0), and the second was left to stand in daylight at room temperature with exclusion of air for 90 days (D90). After 90 days, the anisidine value was determined for all the stored samples and thawed time D0 samples (see "Methods of measurement").

TABLE 4.1

| | rapeseed oil | | | | | |
|---|---|---|---|---|---|---|
| | water content (wt %) | turbidity | rep. water content (wt %) | rep. turbidity | anisidine (D0) | anisidine (D90) |
| pre-purified oil | 2.3 | 2-3 | n.d. | n.d. | n.d. | n.d. |
| T 1 a) | 0.98 | 1-2 | 1.00 | 1-2 | n.d. | n.d. |
| T 1 b) | 0.65 | 1 | 0.92 | 1-2 | n.d. | n.d. |
| T 1 c) | 0.05 | 1 | 0.10 | 1 | n.d. | n.d. |
| T 1 d) | 0.01 | 1 | 0.02 | 1 | 0.5 | 6.3 |
| T 2 a) | 0.82 | 1 | 0.95 | 1 | n.d. | n.d. |
| T 2 b) | 0.07 | 1 | 0.15 | 1 | n.d. | n.d. |
| T 2 c) | 0.05 | 1 | 0.16 | 1 | n.d. | n.d. |
| T 2 d) | 0.02 | 1 | 0.04 | 1 | 0.5 | 6.1 |
| T 3 a) | 1.84 | 2 | 2.32 | 2 | n.d. | n.d. |
| T 3 b) | 1.25 | 1-2 | 1.65 | 1-2 | n.d. | n.d. |
| T 3 c) | 0.95 | 1 | 1.15 | 1-2 | n.d. | n.d. |
| T 3 d) | 0.04 | 1 | 0.10 | 1 | 0.5 | 5.9 |
| T 4 a) | 1.23 | 1-2 | 1.48 | 1-2 | n.d. | n.d. |
| T 4 b) | 0.52 | 1 | 0.76 | 1 | n.d. | n.d. |
| T 4 c) | 0.06 | 1 | 0.08 | 1 | n.d. | n.d. |
| T 4 d) | 0.02 | 1 | 0.04 | 1 | 0.9 | 7.3 |
| T 5 a) | 1.34 | 1-2 | 1.67 | 1-2 | n.d. | n.d. |
| T 5 b) | 0.32 | 1 | 0.45 | 1 | n.d. | n.d. |
| T 5 c) | 0.07 | 1 | 0.12 | 1 | n.d. | n.d. |
| T 5 d) | 0.04 | 1 | 0.07 | 1 | 0.5 | 5.5 |
| T 6 a) | 0.65 | 1 | 0.82 | 1 | n.d. | n.d. |
| T 6 b) | 0.12 | 1 | 0.25 | 1 | n.d. | n.d. |
| T 6 c) | 0.06 | 1 | 0.07 | 1 | n.d. | n.d. |
| T 6 d) | 0.01 | 1 | 0.04 | 1 | 0.5 | 6.5 |
| T 7 | 0.03 | 1 | 2.86 | 2 | 0.8 | 16 |

rep. = repeated introduction of water; oil turbidity: 1 = transparent, 2 = slightly turbid, 3 = moderately turbid, 4 = highly turbid, 5 = milky; n.d. = not carried out.

TABLE 4.2

| | sunflower seed oil | | | | | |
|---|---|---|---|---|---|---|
| | water content (wt %) | turbidity | rep. water content (wt %) | rep. turbidity | anisidine (D0) | anisidine (D90) |
| pre-purified oil | 3.4 | 3 | n.d. | n.d. | n.d. | n.d. |
| T 1 a) | 1.62 | 1-2 | 1.73 | 2 | n.d. | n.d. |
| T 1 b) | 0.83 | 1 | 1.22 | 1-2 | n.d. | n.d. |
| T 1 c) | 0.12 | 1 | 0.19 | 1 | n.d. | n.d. |
| T 1 d) | 0.05 | 1 | 0.09 | 1 | 0.5 | 5.1 |
| T 2 a) | 1.82 | 2 | 2.11 | 2 | n.d. | n.d. |
| T 2 b) | 0.93 | 1 | 1.12 | 1-2 | n.d. | n.d. |
| T 2 c) | 0.13 | 1 | 0.19 | 1 | n.d. | n.d. |
| T 2 d) | 0.05 | 1 | 0.08 | 1 | 0.5 | 4.9 |
| T 3 a) | 1.98 | 2 | 2.31 | 2 | n.d. | n.d. |
| T 3 b) | 1.34 | 1-2 | 1.68 | 1-2 | n.d. | n.d. |
| T 3 c) | 0.12 | 1 | 0.23 | 1 | n.d. | n.d. |
| T 3 d) | 0.09 | 1 | 0.12 | 1 | 0.5 | 5.1 |
| T 4 a) | 2.13 | 2 | 2.75 | 2 | n.d. | n.d. |
| T 4 b) | 1.88 | 2 | 2.13 | 2 | n.d. | n.d. |
| T 4 c) | 1.00 | 1 | 1.65 | 2 | n.d. | n.d. |

TABLE 4.2-continued

| | sunflower seed oil | | | | | |
|---|---|---|---|---|---|---|
| | water content (wt %) | tur-bidity | rep. water content (wt %) | rep. tur-bidity | anisidine (D0) | anisidine (D90) |
| T 4 d) | 0.11 | 1 | 0.18 | 1 | 0.5 | 6.9 |
| T 5 a) | 1.1 | 1-2 | 1.34 | 1-2 | n.d. | n.d. |
| T 5 b) | 0.45 | 1 | 0.66 | 1 | n.d. | n.d. |
| T 5 c) | 0.08 | 1 | 0.14 | 1 | n.d. | n.d. |
| T 5 d) | 0.06 | 1 | 0.08 | 1 | 0.5 | 5.4 |
| T 6 a) | 0.92 | 1 | 1.12 | 1-2 | n.d. | n.d. |
| T 6 b) | 0.19 | 1 | 0.29 | 1 | n.d. | n.d. |
| T 6 c) | 0.08 | 1 | 0.12 | 1 | n.d. | n.d. |
| T 6 d) | 0.05 | 1 | 0.06 | 1 | 0.5 | 4.3 |
| T 7 | 0.07 | 1 | 3.75 | 3 | 1.1 | 18 |

rep. = repeated introduction of water; oil turbidity: 1 = transparent, 2 = slightly turbid, 3 = moderately turbid, 4 = highly turbid, 5 = milky; n.d. = not carried out.

TABLE 4.3

| | grape seed oil | | | | | |
|---|---|---|---|---|---|---|
| | water content (wt %) | tur-bidity | rep. water content (wt %) | rep. tur-bidity | anisidine (D0) | anisidine (D90) |
| pre-purified oil | 3.64 | 3 | n.d. | n.d. | n.d. | n.d. |
| T 1 a) | 1.52 | 1-2 | 1.98 | 2 | n.d. | n.d. |
| T 1 b) | 0.92 | 1 | 1.34 | 1-2 | n.d. | n.d. |
| T 1 c) | 0.21 | 1 | 0.34 | 1 | n.d. | n.d. |
| T 1 d) | 0.02 | 1 | 0.09 | 1 | 0.5 | 6.2 |
| T 2 a) | 1.65 | 1-2 | 1.95 | 2 | n.d. | n.d. |
| T 2 b) | 1.12 | 1-2 | 1.34 | 1-2 | n.d. | n.d. |
| T 2 c) | 0.36 | 1 | 0.68 | 1 | n.d. | n.d. |
| T 2 d) | 0.03 | 1 | 0.10 | 1 | 0.5 | 5.8 |
| T 3 a) | 1.61 | 2 | 2.21 | 2 | n.d. | n.d. |
| T 3 b) | 1.34 | 1-2 | 1.85 | 1-2 | n.d. | n.d. |
| T 3 c) | 0.43 | 1 | 0.82 | 1 | n.d. | n.d. |
| T 3 d) | 0.09 | 1 | 0.16 | 1 | 0.5 | 6.1 |
| T 4 a) | 2.55 | 2 | 3.10 | 3 | n.d. | n.d. |
| T 4 b) | 1.91 | 2 | 2.70 | 3 | n.d. | n.d. |
| T 4 c) | 1.23 | 1-2 | 1.45 | 1-2 | n.d. | n.d. |
| T 4 d) | 0.02 | 1 | 0.04 | 1 | 0.8 | 7.2 |
| T 5 a) | 1.62 | 1-2 | 1.78 | 1-2 | n.d. | n.d. |
| T 5 b) | 0.42 | 1 | 0.65 | 1 | n.d. | n.d. |
| T 5 c) | 0.13 | 1 | 0.21 | 1 | n.d. | n.d. |
| T 5 d) | 0.02 | 1 | 0.08 | 1 | 0.5 | 5.2 |
| T 6 a) | 0.91 | 1 | 1.02 | 1 | n.d. | n.d. |
| T 6 b) | 0.22 | 1 | 0.27 | 1 | n.d. | n.d. |
| T 6 c) | 0.09 | 1 | 0.17 | 1 | n.d. | n.d. |
| T 6 d) | 0.04 | | 0.07 | 1 | 0.5 | 6.1 |
| T 7 | 0.09 | 1 | 3.84 | 3 | 1.2 | 22 |

rep. = repeated introduction of water; oil turbidity: 1 = transparent, 2 = slightly turbid, 3 = moderately turbid, 4 = highly turbid, 5 = milky; n.d. = not carried out.

Summary: A vacuum drying of prepurified oil phases yields a very good reduction in the residual moisture; however, there is a distinct re-introducability of water. The adsorption and complexing agents investigated lead to a rapid reduction in the turbidity of purified oil phases. This was associated with a considerable reduction in the re-introducability of water into the oil phase. Whereas the prepurified and dried oils still comprise secondary oxidation products, the refined and ameliorated oil phases did not contain any more secondary oxidation products which could be determined by means of the p-anisidine method. Over the course of 90 days, substantially more secondary oxidation products were formed in the prepurified and dried oils than in the oil phases which had been ameliorated by means of the adsorption or complexing agents.

Example 5

Investigation on the influence of the prepurification of a lipid phase on the extractability of turbidity-inducing agents.

Pressed gold-of-pleasure oil, having the characteristic numbers (determination of the characteristic oil numbers in accordance with "Methods of measurement") as per Table 5.1, was aqueously refined according to the following methods:

T 1: Phosphoric acid (85% by weight, added amount 0.4% by weight, action time 30 minutes), then aqueous solution containing sodium carbonate (20% by weight, added amount 3% by volume, action time 5 minutes)

T 2: Phosphoric acid (85% by weight, added amount 0.4% by weight, action time 30 minutes), then aqueous solution containing sodium carbonate (20% by weight, added amount 3% by volume, action time 5 minutes), then aqueous solution containing arginine (0.3 molar, added amount 2% by volume, action time 5 minutes)

T 3: Phosphoric acid (85% by weight, added amount 0.4% by weight, action time 30 minutes), then aqueous solution containing sodium hydrogen carbonate (20% by weight, added amount 3% by volume, action time 5 minutes), then aqueous solution containing sodium hydroxide (1 N, added amount 3%, action time 5 minutes)

T 4: Aqueous solution of sodium hydrogen carbonate (20% by weight, added amount 3% by volume, action time 30 minutes), then phosphoric acid (85% by weight, added amount 0.4% by weight, action time 30 minutes)

T 5: Aqueous solution of sodium hydrogen carbonate (20% by weight, added amount 3% by volume, action time 30 minutes), then phosphoric acid (85% by weight, added amount 0.4% by weight, action time 30 minutes), then aqueous solution containing arginine (0.3 molar, added amount 2% by volume, action time 5 minutes)

T 6: Aqueous solution of sodium carbonate (20% by weight, added amount 3% by volume, action time 30 minutes), then phosphoric acid (85% by weight, added amount 0.4% by weight, action time 30 minutes), then aqueous solution containing sodium hydroxide (1 N, added amount 3%, action time 5 minutes)

T 7: Aqueous solution of sodium carbonate (20% by weight, added amount 3% by volume, action time 30 minutes), then aqueous solution of sodium metasilicate (20% by weight, added amount 2%, action time 5 minutes)

T 8: Aqueous solution of sodium bicarbonate (20% by weight, added amount 3% by volume, action time 30 minutes), then aqueous solution of sodium metasilicate (20% by weight, added amount 2%, action time 5 minutes), then aqueous solution containing arginine (0.3 molar, added amount 2% by volume, action time 5 minutes)

T 9: Aqueous solution of sodium bicarbonate (20% by weight, added amount 3% by volume, action time 30 minutes), then aqueous solution of sodium metasilicate (20% by weight, added amount 2%, action time 5 minutes), then phosphoric acid (85% by weight, added amount 0.4% by weight, action time 30 minutes)

T 10: Aqueous solution of sodium hydrogen carbonate (20% by weight, added amount 3% by volume, action time 30 minutes), then aqueous solution of sodium metasilicate (20% by weight, added amount 2%, action time 5 minutes), then aqueous solution containing sodium hydroxide (1 N, added amount 3%, action time 5 minutes)

The aqueous solutions and the undiluted phosphoric acid were added in the specified concentrations and added amounts to 10 liters of the crude oil in each case and homogenized using an intensive mixer (Ultrathurrax, T50, 10 000 rpm for 5 minutes). Then phases were separated by means of a separator (OTC 350, MKR, Germany) (output 30 L/h, drum frequency 10 000 rpm). Thereafter, a sample taken to determine the characteristic numbers (Table 5.1).

TABLE 5.1

| | crude oil | T 1 | T 2 | T 3 | T 4 | T 5 | T 6 | T 7 | T 8 | T 9 | T 10 |
|---|---|---|---|---|---|---|---|---|---|---|---|
| P | 16.2 | 3.3 | 0.92 | 2.9 | 6.5 | 1.4 | 4.6 | 5.12 | 1.1 | 6.3 | 4.92 |
| C | 29.2 | 0.93 | 0.06 | 0.82 | 4.23 | 0.05 | 1.45 | 4.34 | 0.23 | 0.73 | 4.01 |
| I | 2.2 | 0.05 | 0.02 | 0.05 | 1.12 | 0.04 | 0.23 | 1.32 | 0.05 | 0.08 | 1.12 |
| CA | 1.2 | 0.48 | 0.02 | 0.32 | 0.92 | 0.11 | 0.33 | 0.45 | 0.12 | 0.85 | 0.4 |
| W | 1.18 | 1.82 | 3.61 | 2.22 | 0.21 | 2.55 | 1.92 | 2.32 | 3.83 | 0.32 | 2.45 |
| O | 1 | 1-2 | 2-3 | 2 | 1 | 2 | 2 | 2 | 3 | 1 | 2 |

P = phosphorus content [ppm]; C = calcium (mg/kg); I = iron (mg/kg); CA = carboxylic acids (% by weight); W = water content [% by weight]; O = oil turbidity
oil turbidity: 1 = transparent, 2 = slightly turbid, 3 = moderately turbid, 4 = highly turbid, 5 = milky 1000 g of each of the prepurified oil fractions were admixed with the following adsorption and complexing agents:

a) hydroxyethyl cellulose (H 200000 YP2), 0.5% by weight
b) methyl hydroxypropyl cellulose (90SH-100000), 0.5% by weight
c) kaolin (1.5% by weight)
d) aluminum chloride solution (3 molar, added amount 1% by volume)
e) polyaluminum chloride solution (9% by weight, added amount 1% by volume)

The mixing of the oils admixed with adsorption or complexing agents was carried out using a propeller stirrer 300 rpm for 30 minutes. This was followed by a phase separation using a bucket centrifuge (4000 rpm, 5 minutes). Then samples taken to determine the characteristic numbers (Table 5.2 (FIG. 3)).

Summary (Numerical Summary in Table 5.2 as FIG. 3):

For the aqueous refining methods that were used, distinct amounts of water remain in the oils to varying degrees. With a renewed introduction of water and centrifugal removal of the aqueous phase, a somewhat identical amount of water remained in the oil for all the prepurified oil phases. The inventive use of adsorption or complexing agents led to an optimal reduction in the residual water content for refined oils having an elevated water content. At the same time, the reintroduction of water was reduced for all the oils, the effect being distinctly stronger for refined oils which had been prepurified using an arginine solution and especially when the last aqueous refining step was carried out using an arginine solution. There was a distinctly poorer depletion of turbidity-inducing agents, with a distinctly higher re-introducability of water into the ameliorated oil phase, when an acidic wash step was carried out before the use of the substances according to the invention.

Example 6

Investigations on product loss due to adsorption and complexing agents.

Mustard oil (20 liters) having the characteristic numbers (determination of the characteristic oil numbers in accordance with "Methods of measurement") of phosphorus content 16.2 ppm (or 16.2 mg/kg), calcium 8.4 ppm (or 8.4 mg/kg), iron 0.56 ppm (or 0.56 mg/kg), free fatty acids 0.9% by weight, was treated by means of an aqueous refining process consisting of a citric acid solution (25% by weight, added amount 0.5% by weight, action time 20 minutes) and an aqueous arginine solution (0.4 molar, added amount 3%), involving the aqueous solutions being introduced by means of an intensive mixer (Ultrathurrax T50, 10 000 rpm) for 5 minutes. Each phase separation by means of a bucket centrifuge (4000 rpm, 5 minutes). The purified oil had the characteristic numbers of phosphorus content 0.7 ppm (or 0.7 mg/kg), calcium <0.02 ppm (or <0.02 mg/kg), iron <0.02 ppm (or <0.02 mg/kg), free fatty acids 0.05% by weight. The oil was moderately turbid and had a water content of 2.43% by weight. To find the metered amount (minimum metered amount) which allows a reduction in the residual water content to a value of <0.15% by weight and a reduction in the re-introducability (test procedure as per Example 1) of a water content to a value of <0.25% by weight, the adsorption agents a) hydroxyethyl cellulose (H 200000 YP2), b) hydroxyethyl cellulose (H 60000 YP2), c) methyl hydroxypropyl cellulose (90SH-100000) and d) kaolin were each added to 1500 g of the purified oil in steps of 0.2% by weight every 10 minutes, with continuous mixing using a propeller stirrer (400 rpm). Before each further metered addition, a sample was taken for the analyses of the residual water content and of the re-introducability of water, centrifuged after 60 minutes and then appropriately analyzed or processed. Similarly, the minimum metered amount for the complexing agents e) aluminum trichloride, f) aluminum sulfate and g) polyaluminum chloride (9% by weight) was also determined, with 0.2% by weight of a 0.5 molar solution of the compounds e) and f) being mixed in each case into a purified oil phase, as described above. The sample preparation and the analyses were carried out as described above.

After determining the minimum metered amount (see Table 6.1 (FIG. 4)), a renewed test with the adhesion or complexing agents was performed, involving said agents in the respectively determined minimum metered amount being stirred into 500 ml of the prepurified oil over 30 minutes, as described above. Thereafter phase separation as above. The adhesion agents were then present as a solid crumbly mass on the bottom of the centrifuge tubes. The oil phase was decanted and the centrifuge tubes were stored in a heating cabinet at 50° C. for 12 h such that residual oil could completely flow off. Thereafter complete removal of the adsorption agent mass and suspension in 150 ml of n-hexane at 50° C. for 20 minutes. Then filtration of the suspensions through a membrane filter (screening size 20 μm) and collection of the solvent phase, which is subsequently concentrated in a vacuum evaporator. The aqueous phases of the complexing agents are completely taken off with care after centrifugation. The slightly turbid aqueous phases are each vigorously shaken with 150 ml of n-hexane and the phases are separated by means of centrifugation; the solvent phase is taken off and concentrated as above. The solvent residues are weighed and the mass obtained is related to the mass of the oil phase used in order to determine the product loss. The oily residues obtained from the hexane phase are assumed to be the outputted triglyceride fraction. The results are listed in Table 6.1 (FIG. 4). The hexane-extracted cellulose compounds were washed with further solvents. One wash was done with methanol. The phase was concentrated, with which a thin-layer chromatography was carried out in order to analyze phospholipids. In another wash with chloroform, with an addition of HCl, a sample preparation (methylation) for the purposes of fatty acid analysis was performed and a gas chromatography examination was carried out. In another wash with a mixture of acetone and 1-pentanol, a sample preparation for the purposes of determining chlorophyll was performed (see "Methods of measurement" for the method of determination).

Summary (Numerical Results in Table 6.1 as FIG. 4)

Using the determined minimum metered additions of the adsorption and complexing agents, a removal of turbidity-inducing agents without product loss is possible by means of the complexing agents used; by means of the adsorption agents used, the turbidity-inducing agents are removed with minimum product loss. It was possible to show that fatty acids, wax acids, phospholipids and chlorophylls are outputted from the oil by means of the adsorption agents.

Example 7

Evening primrose oil (5000 ml) having the characteristic numbers (determination of the characteristic oil numbers in accordance with "Methods of measurement") of phosphorus content 6.2 ppm (or 6.2 mg/kg), calcium 1.2 ppm (or 1.2 mg/kg), iron 0.31 ppm (or 0.31 mg/kg), free fatty acids 0.82% by weight (or 0.82 g/100 g), was subjected to an ultrafiltration process with a membrane filter having a nominal screening size of 5 μm and a further one having a screening size of 0.45 μm. A sample of the transparent oil was analyzed; the characteristic numbers were practically unchanged in relation to the starting material. Corpuscular constituents in the oil phase were determined by means of DLS (see "Methods of measurement" for the description). In the filtered oil, there were only minimum amounts of particles; these had a diameter of <20 nm with respect to >90% of all particles. The filtered crude oil was optically transparent; a water content of 0.41% by weight was determined, and an introduction of water was carried out by means of the test procedure described in Example 1, with a resulting water content of 2.62% by weight for the oil.

The filtered oil was divided for the following test paths: A) aqueous refining by means of an arginine solution (0.6 molar, added amount 3% by volume), achieved by introducing the aqueous solution by means of an intensive mixer (Ultrathurrax T18, 24 000 rpm) over 10 minutes; B) aqueous refining as in A), but with a mixing-based introduction by means of a propeller stirrer (500 rpm) over 10 minutes; C) immediate addition of the adsorption or complexing agents to the oil and stirring-in as in B).

Following the aqueous refining processes in test paths A) and B), a phase separation was carried out as in Example 5, yielding the oil phases A1) and B1). The following characteristic numbers were determined for the prepurified oil, for A1): phosphorus content 0.7 ppm (or 0.7 mg/kg), calcium 0.02 ppm (or 0.02 mg/kg), iron <0.02 ppm (or <0.02 mg/kg), free fatty acids 0.08% by weight, and for B1): phosphorus content 1.2 ppm (or 1.2 mg/kg), calcium 0.09 ppm (or 0.09 mg/kg), iron 0.03 ppm (or 0.03 mg/kg), free fatty acids 0.10% by weight. Both oils were moderately turbid. For half of each of the prepurified oil phases from A1) and B1), a vacuum drying process was performed, yielding equal volume fractions of the prepurified oil phases A1) and B1) and of the prepurified and dehydrated oil phases A2) and B2). The oil phase A2) obtained was halved and one of the halves was put aside with the designation A4) for a further test. The adsorption agents hydroxyethyl cellulose (H 60000 YP2) (a) and methyl hydroxypropyl cellulose (90SH-100000) (b) (added amount 0.5% by weight in each case) and the complexing agents aluminum trichloride (1.0 molar, added amount 1% by weight) (c) and polyaluminum chloride (9% by weight, added amount 0.5% by weight) (d) were added to the oil phases A1), A2), B1) and B2). Mixing was carried out using a propeller stirrer (500 rpm for 20 minutes) followed by a phase separation using a glass beaker centrifuge (3800 rpm/10 minutes). The oil supernatants A1"), A2"), B1") and B2") obtained were taken off and samples were taken for analysis and for a test in relation to the introducability of water, in accordance with the test procedure of Example 1. The oil phases A2") and B2") obtained were admixed with an arginine solution (0.1 molar, added amount 2% by weight) and the phases were homogenized using the intensive mixer (24 000 rpm, 2 minutes). Thereafter phase separation as described above, yielding the oil phases A3) and B3). Both oil phases were turbid; samples were taken for analysis. After that, the adsorption and complexing agents (a), (b), (c) and (d) were again added as above to the obtained prepurified oil phases A3) and B3) in the same volume and concentration ratios and mixed in as described above. Thereafter phase separation by means of centrifugation. From the refined and ameliorated oils A3") and B3") obtained, samples were taken for analysis and for examining the introducability of water. The oil phase A4) obtained after aqueous refining was filtered using the filter unit described at the start. The filtered oil phase A4f) obtained had optically a lower turbidity. Samples are made for analysis and a test in relation to the re-introducability of water.

The oil of test path C), which was obtained as oil phase C" after the treatment with the adsorption or complexing agents, which were added in the same volume ratios and concentrations and using the same process parameters as in test paths A) and B), and after appropriate phase separation, was examined with respect to the water content and the introducability of water, as described above. Oil phase C" was then prepurified by means of an aqueous refining using an arginine solution in line with the procedure and the process parameters in test path A). After phase separation, which was carried out similarly to the phase separation mentioned above, the prepurified turbid oil phase C1 was obtained; samples taken for analysis and introducability of water. The adsorption and complexing agents (a), (b), (c) and (d) were stirred again into the prepurified oil C1) in the same volume and concentration ratios as before and under the same process conditions. Thereafter phase separation, yielding the refined and ameliorated oil phase C1"), and sample taken for analysis and for introduction of water, as described above.

For all the prepurified and refined oil phases, there was in parallel an assessment of the optically determined turbidity and of the determination of a turbidity value by means of a turbidimetry measurement system (see "Methods of measurement"). In addition, for the refined oil phases, particles or drops present therein were determined by means of DLS.

Results (the Numerical Results are Shown in Table 7 (FIG. 5)):

The inventive adsorption agents, which were added in anhydrous form to an ultrafiltered crude oil, led to a low reduction in the water content present therein. The mixing of aqueous solutions containing the inventive complexing agents into an ultrafiltered, but not aqueously refined, oil phase led to an elevation of the water content of the oil phase. After centrifugal removal of the adsorption and complexing agents, there was in both cases a distinct introducability of water into the oil phase. The thus pretreated oil phases had, after an aqueous refining which was then carried out, similarly high values for water bound therein or for a further introducability of water into the prepurified oil phase as was the case when the crude oil had been immediately treated with a similar aqueous refining process. Therefore, there was no relevant discharge of turbidity-inducing agents as a result of the introduction of the inventive adsorption or complexing agents into a crude oil. Oil which had been subjected to an aqueous refining according to the invention and in which the turbidity-inducing agents remaining therein were present in hydrated form could be cleared of the turbidity-inducing agents by the adsorption or complexing agents, and, as a result, it was possible to achieve a low residual moisture content and a low re-introducability of water. When the prepurified oil phases did not contain relevant amounts of water any more as a result of a vacuum drying process, a relevant output of turbidity-inducing agents by means of the adsorption or complexing agents used was not possible, and this was evident by a distinct re-introducability of water into the treated oil phases.

If, in the case of such an oil phase, a further aqueous refining step was carried out and the turbidity-inducing agents were present in hydrated form again, a depletion of the turbidity-inducing agents with the same adsorption or complexing agents was possible, yielding a low oil residual moisture and a low re-introducability of water into the oil phase. A determination of the particles or droplets present in the refined oils showed that, for all samples which were rated as transparent and had a turbidity value of 5 FTU, less than 5% of all measured particles/droplets were >20 nm. In transparent refined oil phases in which the turbidity measurement yielded values of up to 16 FTU, there were also particles/droplets having a peak at 60 nm, wherein their proportion was below 5% of particles/droplets which were <10 nm. Thus, it can be largely ruled out that aggregates or complexes were formed as a result of the compounds used or the employed aggregation agents themselves remain in the refined oil phase.

Example 8

Large-Scale Use 5000 liters of pressed rapeseed oil is subjected to an aqueous refining according to the following scheme: 1. phosphoric acid (85%, added amount 0.4%), 2. aqueous solution containing sodium carbonate (20% by weight, added amount 3% by weight), 3. aqueous solution containing arginine (0.3 molar, added amount 2% by weight). The acid and the aqueous solutions are homogenized by means of an inline intensive mixer (DMS2.2/26-10, Fluko, Fluid Kotthoff, Germany) at a throughput volume of 3 m3/h, at a rotational frequency of 2700 rpm for the dispersion tool. After each mixing-based introduction, a phase separation is carried out using a separator (AC1500-430 FO, Flottweg, Germany) at a throughput capacity of 3 m3/h and a drum speed of 6500 rpm (max. centrifugal acceleration 10 000·g). The refined oil fractions are each temporarily stored in a reservoir tank until performance of the next refining step. After the 3rd refining step, the oil has the following characteristic numbers: phosphorus content 0.9 ppm (or 0.9 mg/kg), calcium <0.02 ppm (or <0.02 mg/kg), iron <0.02 ppm (or <0.02 mg/kg), free fatty acids 0.07% by weight, water content 2.9% by weight. (See test methods for the procedure.) The oil is distinctly turbid. The purified oil from the 3rd refining step is filled in 2 fractions of 2450 liters each into Reservoir Tanks 1 and 3. 6.6 kg of hydroxyethyl cellulose (H 200000 YP2) present in the form of a fine powder are added to Reservoir Tank 1 under continuous stirring with a propeller stirrer (400 rpm) within 3 minutes and then further stirred for 15 minutes. After that, a pump is used to pump the oil phase into a cartridge filter unit (screening size 2 μm). The outlet of the filter unit is connected to Reservoir Tank 2 for retention of the refined oil phase.

46 liters of a 3 molar aluminum trichloride solution are added to the purified oil in Reservoir Tank 3. Via a base outlet of the reservoir tank that is connected to a pipe, the oil/water mixture is pumped into the aforementioned inline rotor-stator mixing unit and mixed therein at a rotational frequency of 1000 rpm at a product throughput of 6 m3/h. The mixed oil/water phase is returned to Reservoir Tank 3. The mixing process is carried out for 15 minutes, involving theoretically a 3-times throughput of the entire oil mixture volume by the mixing unit. This is followed by a phase separation using the aforementioned separator, as described above. The oil phase is then run into Reservoir Tank 4 via a pipe. Samples are collected from Reservoir Tanks 2 and 4 for analysis. Both refined oil phases are transparent; the oil from Reservoir Tank 2 contains a residual moisture of 0.02% by weight, and the oil from Reservoir Tank 4 contains a residual moisture of 0.03% by weight. The re-introducability of water is examined, as described in Example 1. This revealed a water content of 0.09% by weight for the oil from Reservoir Tank 2 and of 0.08% by weight for the oil from Reservoir Tank 4.

The invention claimed is:

1. A method for adsorbing and extracting or complexing and extracting water-binding organic lipophilic turbidity-inducing agents of aqueously refined lipid phases, characterized by a) providing a lipid phase containing water-binding organic lipophilic turbidity-inducing agents, the lipid phase having been subjected to at least one aqueous refining with a neutral or basic solution, b) admixing the lipid phase from step a) with an adsorption agent and/or a complexing agent, c) separating adsorbed or complexed water-binding organic lipophilic turbidity-inducing agents from step b) by means of a sedimentation-based, centrifugal or filtration-based separation technique, wherein the adsorption agent is cellulose, a nonionic or anionic cellulose derivative or an inorganic aluminum oxide silicate having an aluminum fraction of >0.1 mol % and the complexing agent comprises aluminum ions or iron ions which are present in an aqueous solution.

2. The method according to claim 1, characterized in that the at least one aqueous refining is carried out in step a) with an aqueous solution containing at least one guanidine-group- or amidine-group-bearing compound having a $K_{OW}$ of <6.3.

3. The method according to claim 1, wherein the adsorption agent and/or the complexing agent of step b) has been immobilized or bound in a fabric or in a texture, wherein the fabric or the texture is suitable for complexing and/or adsorption and/or filtration of the turbidity-inducing agents.

4. The method according to claim 1, characterized in that a lipid phase containing less than 0.5% by weight of water is obtained after step c).

5. The use of the method according to claim 1 for removing and for obtaining water-binding organic lipophilic turbidity-inducing agents, characterized by a) providing a lipid phase containing water-binding organic lipophilic turbidity-inducing agents, the lipid phase having been subjected to at least one aqueous refining with a neutral or basic solution, b) admixing the lipid phase from step a) with an adsorption agent and/or a complexing agent, c) separating adsorbed or complexed water-binding organic lipophilic turbidity-inducing agents from step b) by means of a sedimentation-based, centrifugal, or filtration-based separation technique, wherein the adsorption agent is cellulose, a nonionic or anionic cellulose derivative or an inorganic aluminum oxide silicate having an aluminum fraction of >0.1 mol % and the complexing agent comprises aluminum ions or iron ions which are present in an aqueous solution.

6. The use of the method according to claim 1 for reducing the water reuptake capacity in a lipid phase and/or for improving the oil shelf life or the oxidation stability of plant oil, characterized by a) providing a lipid phase containing water-binding organic lipophilic turbidity-inducing agents, the lipid phase having been subjected to at least one aqueous refining with a neutral or basic solution, b) admixing the lipid phase from step a) with an adsorption agent and/or a complexing agent, c) separating adsorbed or complexed water-binding organic lipophilic turbidity-inducing agents from step b) by means of a sedimentation-based, centrifugal, or filtration-based separation technique, wherein the adsorption agent is cellulose, a nonionic or anionic cellulose derivative or an inorganic aluminum oxide silicate having an aluminum fraction of >0.1 mol % and the complexing agent comprises aluminum ions or iron ions which are present in an aqueous solution.

* * * * *